US009179740B2

(12) United States Patent
Connell et al.

(10) Patent No.: US 9,179,740 B2
(45) Date of Patent: Nov. 10, 2015

(54) PROTECTIVE MEMBER FOR AN ARTICLE OF FOOTWEAR

(71) Applicant: Nike, Inc., Beaverton, OR (US)

(72) Inventors: Jeremy L. Connell, Hillsboro, OR (US); David P. Jones, Beaverton, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 376 days.

(21) Appl. No.: 13/746,473

(22) Filed: Jan. 22, 2013

(65) Prior Publication Data

US 2014/0202033 A1 Jul. 24, 2014

(51) Int. Cl.

| | |
|---|---|
| ***A43C 13/00*** | (2006.01) |
| ***A43B 3/16*** | (2006.01) |
| ***A43B 5/18*** | (2006.01) |
| ***A43D 95/14*** | (2006.01) |
| ***A43D 11/00*** | (2006.01) |

(52) U.S. Cl.

CPC . *A43C 13/00* (2013.01); *A43B 3/16* (2013.01); *A43B 5/185* (2013.01); *A43D 11/003* (2013.01); *A43D 95/14* (2013.01)

(58) Field of Classification Search

CPC ..... A43B 5/185; A43B 5/18; A43B 3/16; A43C 13/00; A43D 11/003; A43D 95/14

USPC ..... 36/72 C, 73, 72 R, 81; 12/142 K

See application file for complete search history.

(56) References Cited

U.S. PATENT DOCUMENTS

| | | | | |
|---|---|---|---|---|
| 1,458,218 | A * | 6/1923 | Brisben | 36/73 |
| 1,970,600 | A | 8/1934 | Frost | |
| 2,182,022 | A | 12/1939 | Griswold | |
| 2,261,102 | A * | 10/1941 | Becker | 36/72 C |
| 2,466,598 | A * | 4/1949 | La Civita | 36/72 C |
| 2,537,785 | A | 1/1951 | Oppenheim | |
| 2,651,119 | A | 9/1953 | Harrington | |
| 2,651,857 | A | 9/1953 | Griswold et al. | |
| 2,700,230 | A * | 1/1955 | Beyer | 36/81 |
| 2,747,304 | A * | 5/1956 | Linenkohl | 36/72 C |
| 4,265,033 | A * | 5/1981 | Pols | 36/110 |
| 5,477,577 | A | 12/1995 | Hadley | |
| 7,563,341 | B2 | 7/2009 | Ferguson et al. | |
| 7,779,560 | B2 * | 8/2010 | Kay | 36/135 |
| 8,162,022 | B2 | 4/2012 | Hull et al. | |
| 8,458,926 | B2 * | 6/2013 | Ewans | 36/97 |
| 2006/0123567 | A1 | 6/2006 | Morlacchi | |
| 2007/0130805 | A1 | 6/2007 | Brady et al. | |
| 2010/0084083 | A1 | 4/2010 | Hull et al. | |
| 2013/0192089 | A1 * | 8/2013 | Ickrath et al. | 36/81 |

* cited by examiner

*Primary Examiner* — Jila M Mohandesi

(74) *Attorney, Agent, or Firm* — Plumsea Law Group, LLC

(57) ABSTRACT

A protective system for articles of footwear includes a protective member that may be used to protect a sole structure from components of a graphic transfer assembly. The protective member can include adjustment members for adjusting the effective depth of different portions of the protective member. The protective member can also include adjustable covering portions for protecting portions of an upper.

31 Claims, 19 Drawing Sheets

PROTECTIVE MEMBER FOR AN ARTICLE OF FOOTWEAR

BACKGROUND

The present embodiments relate generally to protective members for articles of footwear.

Articles of footwear generally include two primary elements: an upper and a sole. The upper may be formed from a variety of materials that are stitched or adhesively bonded together to form a void within the footwear for comfortably and securely receiving a foot. The sole is secured to a lower portion of the upper and is generally positioned between the foot and the ground. In many articles of footwear, including athletic footwear styles, the sole often incorporates an insole, a midsole, and an outsole.

SUMMARY

In one aspect, a protective system for an article of footwear includes a protective member, where the protective member is configured to cover a sole structure. The protective member includes an interior cavity, where the interior cavity further includes an interior portion. The interior portion has an effective depth, where the effective depth is associated with the shallowest portion of the interior portion. The protective system also includes at least one adjustment member that can be removably attached to interior portion. The at least one adjustment member can be used to decrease the effective depth of the interior portion.

In another aspect, a protective system for an article of footwear includes a protective member, where the protective member is configured to cover a sole structure. The protective member includes an attachment region disposed on an outer portion of the protective member. At least one adjustable covering portion can be removably attached to the attachment region. The at least one adjustable covering portion is configured to selectively cover a portion of an upper.

In another aspect, a protective system for an article of footwear includes a protective member, where the protective member is configured to cover a sole structure. The protective member includes an interior cavity. The interior cavity further includes a first interior portion and a second interior portion. The first interior portion has a first effective depth, where the first effective depth is associated with the shallowest portion of the first interior portion. The second interior portion has a second effective depth, where the second effective depth is associated with the shallowest portion of the second interior portion. A first adjustment member can be removably attached to the first interior portion and the first adjustment member can be used to change the first effective depth of the first interior portion so that the first effective depth is substantially different than the second effective depth.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
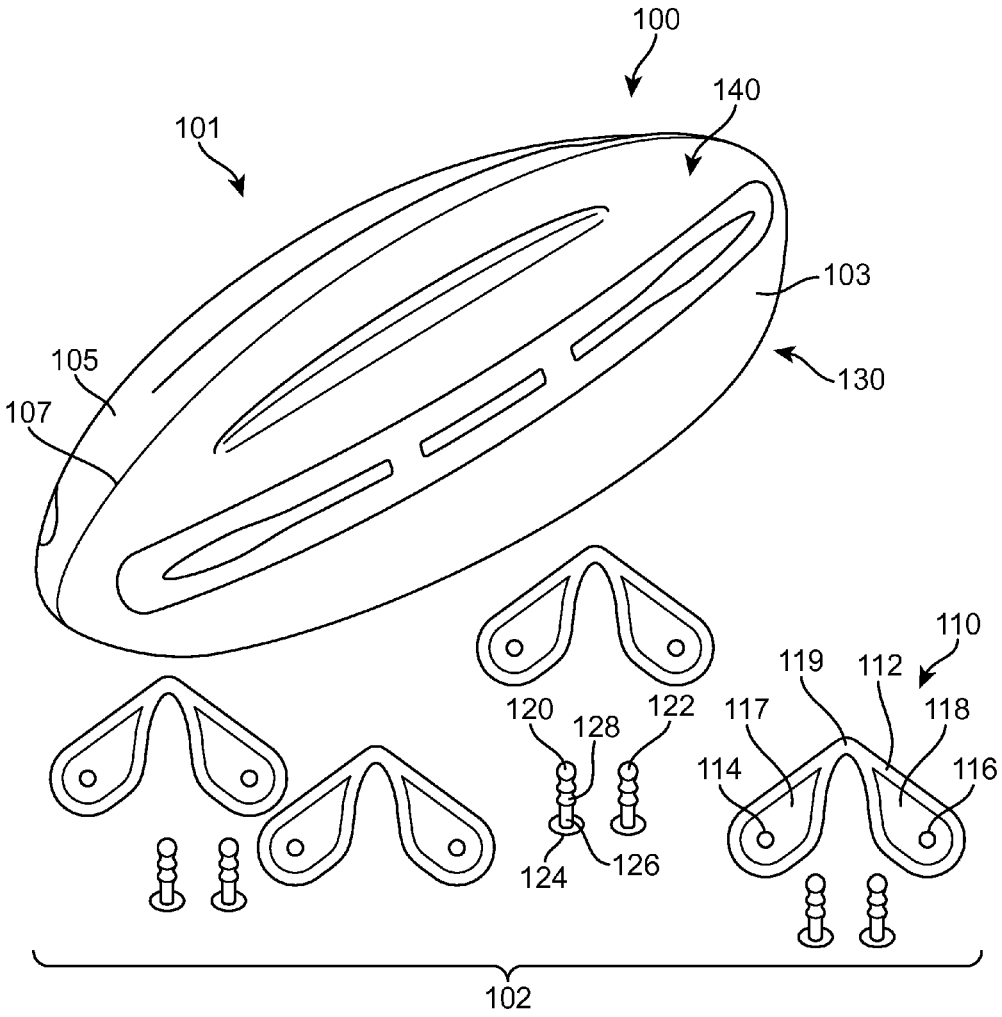
FIG. 1 is a schematic view of an embodiment of a protective system for an article of footwear including a protective member and a plurality of adjustment members in a disassembled state.
Figure 2:
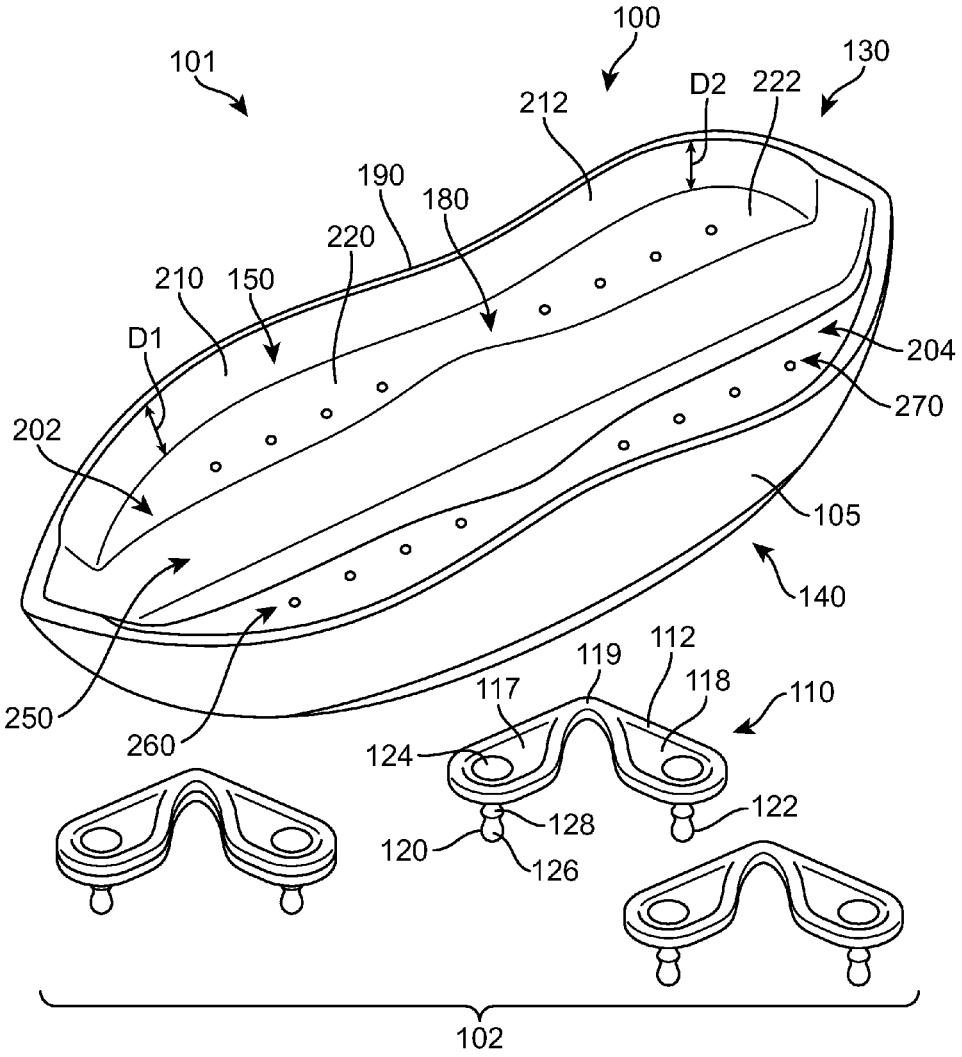
FIG. 2 is a schematic view of an interior cavity of the protective member of FIG. 1 and a plurality of adjustment members in an assembled state.

FIGS. 1 and 2 illustrate views of an embodiment of protective system 101. Protective system 101 can include protective member 100 as well as plurality of adjustment members 102. In one embodiment, protective system 101 may be configured for use with a graphic transfer assembly. An example of various types of graphic transfer assemblies are disclosed in Hull et al., U.S. Pat. No. 8,162,022, now U.S. patent application Ser. No. 12/245,402, filed Oct. 3, 2008 and issued on Apr. 24, 2012, the entirety of which is hereby incorporated by reference. For purposes of convenience, this application may be referred to hereafter as the "Hull case". More generally, the term "graphic transfer assembly" as used throughout this detailed description and in the claims refers to any collection of components which may be used to transfer a graphic to an object.

For clarity, the following detailed description discusses an exemplary embodiment of a protective system that can be used with articles of footwear, but it should be noted that the protective system may be configured for use with any other kinds of articles. In some embodiments, the protective system may be configured for use with articles that can be worn, including, but not limited to: footwear, gloves, shirts, pants, socks, scarves, hats, jackets, as well as other articles. In other embodiments, the protective system may be configured for use with protective equipment, including, but not limited to: shin guards, knee pads, elbow pads, shoulder pads, as well as any other type of protective equipment. Additionally, in some embodiments, the protective system could be configured for use with non-wearable articles, including, but not limited to: balls, bags, purses, backpacks, as well as other articles that may not be worn.

For consistency and convenience, the terms proximal and distal may also be used throughout this detailed description. The term "proximal" as used throughout this detailed description and in the claims refers to a direction generally closer to an article of footwear when the protective member is positioned over a portion of the article of footwear. The term "distal" as used throughout this detailed description and in the claims refers to a direction generally further from an article of footwear when the protective member is positioned over a portion of the article of footwear.

In some cases, protective member 100 can be configured as a substantially rigid cover for an article of footwear. An example of such a protective member is disclosed in U.S. patent application Ser. No. 13/746,415, entitled "Protective Cover and Graphic Transfer Assembly", filed on Jan. 22, 2013, which application is hereby incorporated by reference in its entirety. In other words, in some cases, protective member 100 may have a fixed shape that does not substantially change during a graphic transfer process. In other cases, however, protective member 100 could comprise a substantially flexible material. In still other cases, protective member 100 could be configured with any level of rigidity, durability or other material properties.

Figure 7:
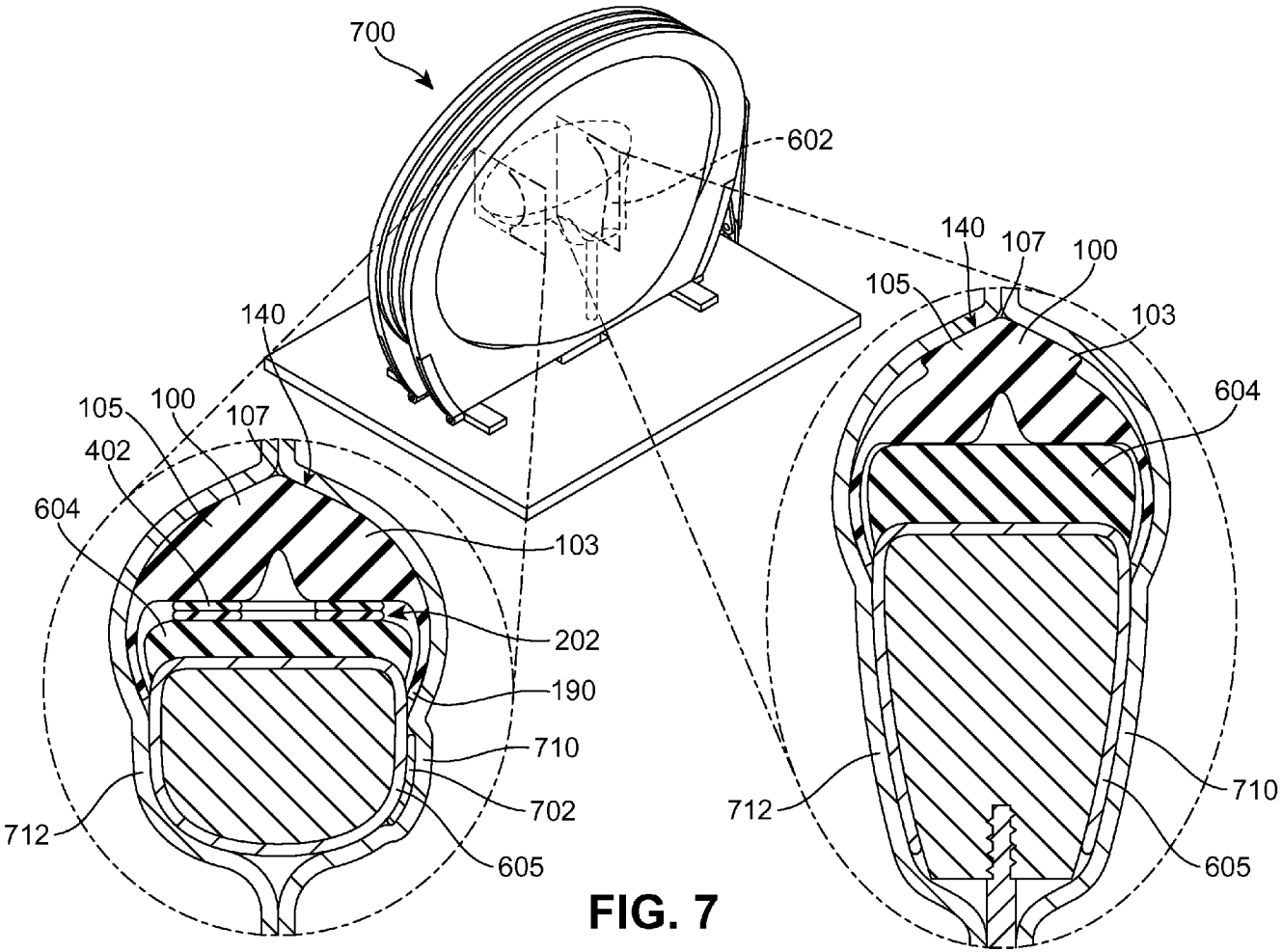
FIG. 7 is a schematic view of an embodiment of a graphic transfer assembly, in which a protective member is used to protect a sole structure.

In some cases, protective member 100 may comprise a substantially contoured member. In particular, protective member 100 may comprise a contoured first side portion 103 and a contoured second side portion 105. First side portion 103 and second side portion 105 may be separated at proximal portion 130 of protective member 100. In some cases, first side portion 103 and second side portion 105 may be joined together within distal portion 140. In some embodiments, first side portion 103 and second side portion 105 may be joined together to form a surface that includes contours or is otherwise non-flat. For example, referring to the cross-sections of protective member 100 depicted in FIG. 7, first side portion 103 and second side portion 105 are shown extending above a sole structure 604. In some embodiments, first side portion 103 and second side portion 105 may loin and form a rounded or substantially pointed edge that is associated with distal portion 140 of protective member 100. Referring specifically to FIGS. 1 and 7, protective member 100 can in some embodiments include a tapered edge 107 along one end. In some embodiments, tapered edge 107 can be proximate to distal portion 140 of protective member 100. In one embodiment, tapered edge 107 may extend along or comprise the most distally situated portion of protective member 100.

In some embodiments, proximal portion 130 can be configured to receive a sole structure of an article of footwear. The term "sole structure" as used throughout this detailed description and in the claims refers to any portion of a sole, including, but not limited to: an outsole, a midsole or an insole, as well as any combination of these components. As described above, in other embodiments where protective member 100 is configured for use with other kinds of articles, proximal portion 130 may be configured to receive any other portion of an article.

Proximal portion 130 may include opening 150 that provides access to interior cavity 180. In some cases, interior cavity 180 includes first interior portion 202 and second interior portion 204. Each interior portion may generally comprise a sidewall portion and a base portion. For example, first interior portion 202 includes first sidewall portion 210 and second interior portion 204 includes second sidewall portion 212. Also, first interior portion 202 includes first base portion 220 and second base portion 222. In one embodiment, first interior portion 202 may be a forefoot portion and the second interior portion 204 may be a heel portion. In other words, in one embodiment, first interior portion 202 may be configured to cover the forefoot portion of a sole and second interior portion 204 may be configured to cover the heel portion of a sole. In other embodiments, however, first interior portion 202 and second interior portion 204 could be associated with any other portions of an article.

In some embodiments, interior cavity 180 may also include a central channel 250 that extends through the length of interior cavity 180. In particular, central channel 250 may extend through both first interior portion 202 and second interior portion 204. In some cases, central channel 250 may be a portion that is recessed with respect to first base portion 220 and second base portion 222. Central channel 250 may help reduce the weight of protective member 100 by decreasing the volume of material comprising protective member 100. In other embodiments, however, central channel may be optional. In such cases, first base portion 220 and second base portion 222 may comprise substantially flat surfaces that extend across the width of interior cavity 180.

Each interior portion may be characterized by a depth. The depth of an interior portion may refer to the distance by which a base portion is recessed with respect to peripheral edge 190 of proximal portion 130. For example, as seen in FIG. 2, first base portion 220 is recessed with respect to peripheral edge 190 by a depth D1. Also, second base portion 222 is recessed with respect to peripheral edge 190 by a depth D2.

In some embodiments, depth D1 and depth D2 may be substantially equal. In such cases, first base portion 220 and second base portion 222 may comprise a generally continuous surface of constant depth. However, in other embodiments, depth D1 and depth D2 could be substantially different. In such cases, the depth of interior cavity 180 may change gradually or abruptly between first base portion 220 and second base portion 222.

In situations where a base portion is approximately flat, the depth of an interior portion can be characterized by measuring the depth at any region of the base portion. However, in situations where the base portion is not flat, the depth of an interior portion can be approximated by an effective depth. The term "effective depth" as used throughout this detailed description and in the claims refers to the depth of an interior portion at the shallowest region (i.e., the region of smallest depth). The effective depth may represent the amount by which a substantially flat sole may be inserted into interior cavity 180. In the embodiment shown in FIG. 2, for example, first base portion 220 is an approximately flat portion, and therefore the effective depth may be approximately equivalent to the depth measured at any particular region of first base portion 220. However, in other cases, the effective depth may not be equivalent to the depth measured at any particular location.

In some cases, a protective system can include provisions for modifying the effective depth of an interior cavity. For example, in some cases one or more components or parts could be inserted into an interior cavity in order to decrease the effective depth of the interior portion. In some cases, one or more adjustment members could be fastened to a base portion in order to adjust the effective depth of an interior portion.

Protective system 101 may also include plurality of adjustment members 102. For purposes of illustration, components of plurality of adjustment members 102 are shown in a disassembled state in FIG. 1 and in an assembled state in FIG. 2. The term "adjustment member" as used throughout this detailed description and in the claims refers to any member or object that can be used to adjust the effective depth of an interior portion of an interior cavity. For purposes of illustration, three adjustment members are shown in FIGS. 1 and 2. However, other embodiments can include any other number of adjustment members.

In some cases, each adjustment member may further include at least one stackable member and at least one post member. For example, first adjustment member 110 comprises first stackable member 112. Each of the remaining adjustment members of plurality of adjustment members 102 may also include one or more stackable members.

In different embodiments, the geometry of first stackable member 112 could vary. Generally, first stackable member 112 could have any shape including, but not limited to: a square, a rectangular shape, a rounded shape, a circular shape, an elliptic shape, a polygonal shape, a regular shape, an irregular shape as well as any other kind of shape. In one embodiment, first stackable member 112 comprises first lobe portion 117 and second lobe portion 118. First lobe portion 117 and second lobe portion 118 may be joined at connecting portion 119. In some cases, first stackable member 112 may have a butterfly wing-like shape.

First stackable member 112 can include one or more holes. In some cases, first stackable member 112 includes first hole 114 and second hole 116. In other cases, first stackable member 112 could include a single hole. In still other cases, first stackable member 112 could include more than two holes.

In some cases, first adjustment member 110 can include first post member 120 and second post member 122. In some cases, first post member 120 and second post member 122 may be sized and shaped to be inserted through first hole 114 and second hole 116 of first adjustment member 110. In particular, first post member 120 includes head portion 124 and shaft portion 126. Shaft portion 126 extends through first hole 114. Head portion 124 may have a diameter that is substantially larger than first hole 114, so that head portion 124 cannot be inserted through first hole 114. Additionally, in some cases, shaft portion 126 is configured with one or more locking ridges 128 that are substantially similar in diameter to first hole 114. Locking ridges 128 may be used to secure a stackable member to first post member 120. In some cases, for example, a stackable member may be secured in place along shaft 126 at locations between adjacent locking ridges 128. Second post member 122 may be configured in a similar manner to first post member 120. In particular, second post member 122 is configured to be inserted through second hole 116 and may have a substantially similar geometry to first post member 120.

It will be understood that each of the adjustment members of plurality of adjustment members 102 may include one or more stacking members that are substantially similar to first stacking member 112. Also, each of the adjustment members of plurality of adjustment members 102 may include one or more post members that are substantially similar to first post member 120 and second post member 122. It will also be understood that the shapes and/or relative sizes of stackable members could vary between different adjustment members. Also, the number of holes and/or associated post members could vary between different adjustment members.

For purposes of illustration, the stacking members comprising plurality of adjustment members 102 are shown as having substantially similar thicknesses. In some cases, each stacking member may have a similar predetermined thickness. This arrangement may allow a user to automatically adjust the effective depth of the interior cavity in increments of the predetermined thickness. However, in other embodiments, the thickness of different stacking members could vary.

Protective member 100 can include provisions for receiving adjustment members 102. In some cases, protective member 100 may include one or more fastening holes that are configured to receive post members. In one embodiment, protective member 100 includes first set of fastening holes 260 and second set of fastening holes 270 that are associated with first interior portion 202 and second interior portion 204, respectively. First set of fastening holes 260 and second set of fastening holes 270 may each comprise four pairs of fastening holes. Moreover, each pair of fastening holes can be configured to receive a pair of post members in order to fasten an adjustment member within interior cavity 180. In still other embodiments, first set of fastening holes 260 and second set of fastening holes 270 may include any other number of fastening holes.

Figure 3:
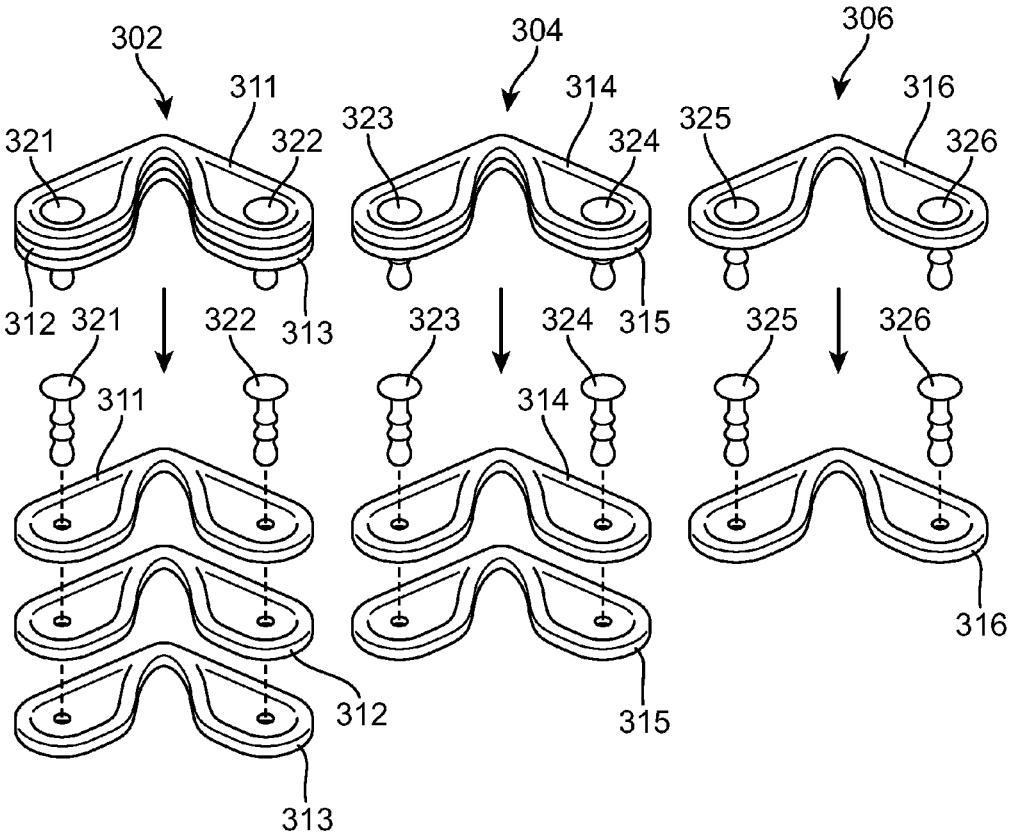
FIG. 3 is a schematic view of an embodiment of three adjustment members comprising three different thicknesses.

FIG. 3 illustrates an embodiment of three adjustment members in exploded and assembled states. Referring to FIG. 3, each adjustment member may comprise one or more stacking members that are joined using two post members. For example, first adjustment member 302 may comprise three stacking members, including first stacking member 311, second stacking member 312 and third stacking member 313. First stacking member 311, second stacking member 312 and third stacking member 313 may be joined using first post member 321 and second post member 322. As another example, second adjustment member 304 may comprise two stacking members, including fourth stacking member 314 and fifth stacking member 315 that are joined using third post member 323 and fourth post member 324. As still another example, third adjustment member 306 may comprise a single stacking member, including sixth stacking member 316 that may be combined with fifth post member 325 and sixth post member 326. This arrangement provides a method for easily creating adjustment members of different thicknesses. In particular, by combining multiple stacking members, the overall thickness of an adjustment member can be increased.

Although the current embodiment illustrates adjustment members comprising three, two or one stackable members, other embodiments could include adjustment members with four or more stackable members. Moreover, as discussed above, some embodiments could include stackable members of varying shapes and/or sizes.

In different embodiments, the materials comprising components of protective system 101 may vary. In some embodiments, materials for protective member 100 can be selected to achieve a desired degree of rigidity, density, weight and/or durability. In some cases, materials having low thermal conductivity could be selected. Using materials with low thermal conductivities may help protect a sole structure from heat applied during a graphic transfer process. Examples of different materials that could be used for protective member 100 include, but are not limited to: polymers, plastics, low density foam, high density foam, composite materials, as well as any other materials.

Materials for adjustment members can be selected to achieve desired material properties, such as rigidity, density and/or durability. In some cases, components of an adjustment member may comprise a substantially rigid material in order to maintain a fixed effective depth for the protective member during use with a graphic transfer assembly. Examples of different materials that could be used for stackable members and/or post members of an adjustment member include, but are not limited to: polymers, plastics, metals, rubbers, foams, wood, as well as any other materials. In one embodiment, stackable members and post members may be made of plastic.

Figure 4:
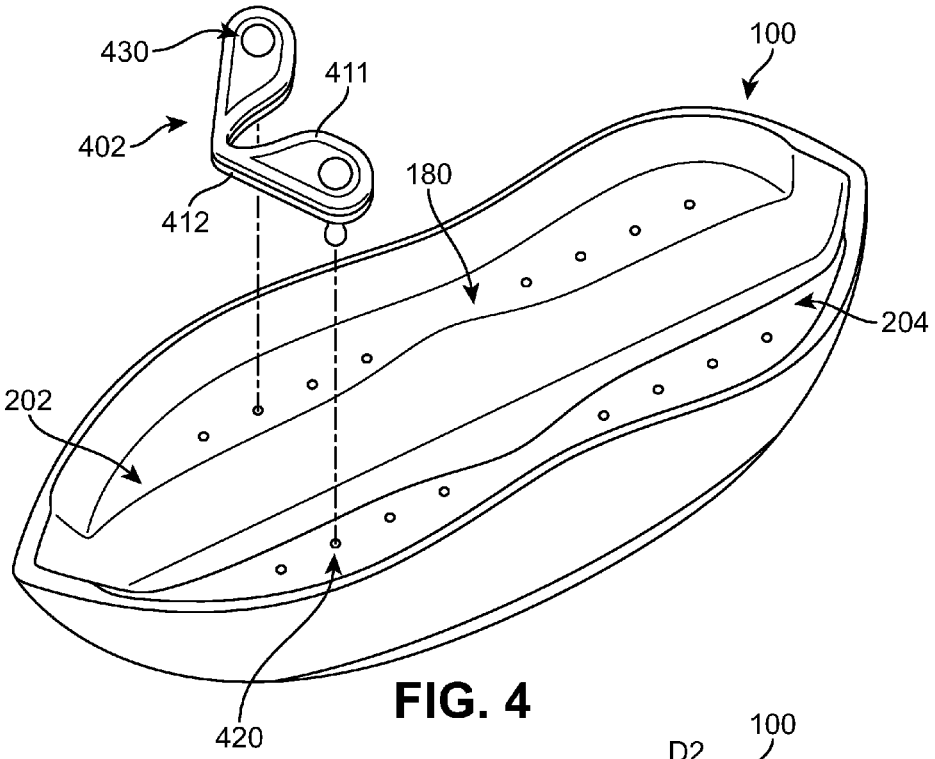
FIG. 4 is a schematic view of an embodiment of an adjustment member configured for attachment to a first interior portion of a protective member.
Figure 5:
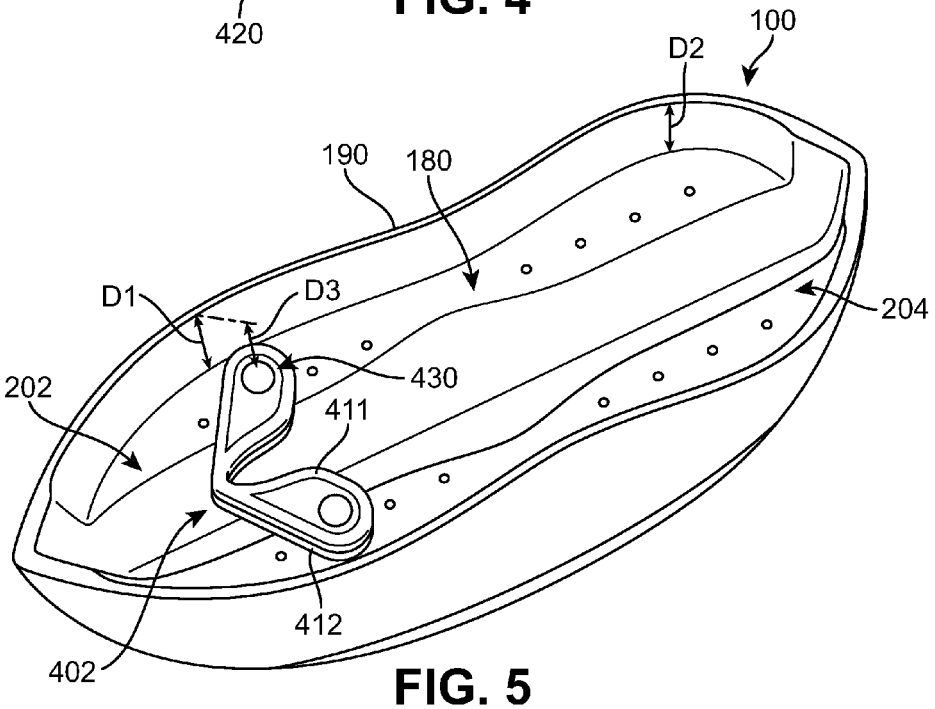
FIG. 5 is a schematic view of the adjustment member of FIG. 4 attached to the protective member.

FIGS. 4 and 5 illustrate schematic views of an embodiment of an adjustment member used to modify the effective depths of first interior portion 202 of interior cavity 180. In this case, first adjustment member 402 comprises first stackable member 411 and second stackable member 412. First adjustment member 402 may be fastened to first pair of fastening holes 420 using first set of post members 430. As seen in FIG. 5, this arrangement modifies the effective depth of first interior portion 202 and second interior portion 204. In particular, the effective depth of first interior portion 202 is decreased to depth D3. Moreover, depth D3 may be less than depth D2, which is associated with second interior portion 204. Using this arrangement, protective member 100 may be configured to cover a sole structure with a variable thickness, as discussed in an example below.

Figure 6:
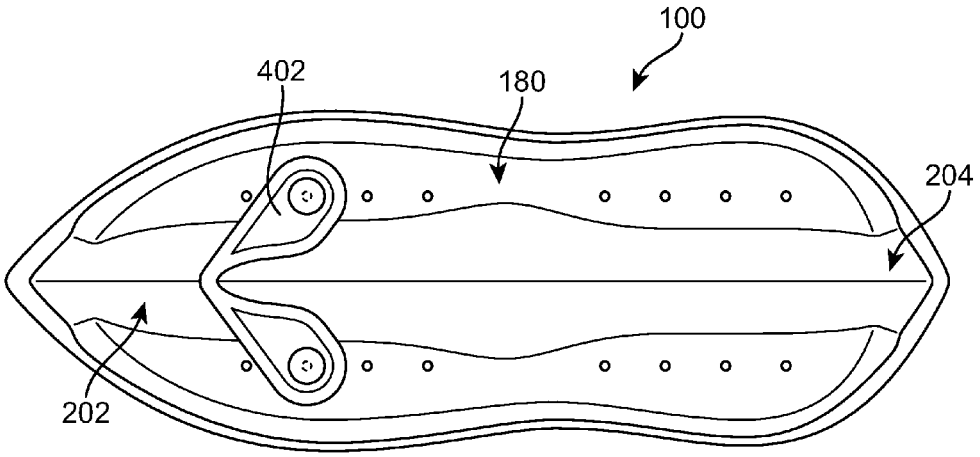
FIG. 6 is a schematic view of an embodiment of a protective member including one adjustment member being associated with an article of footwear.
Figure 6:
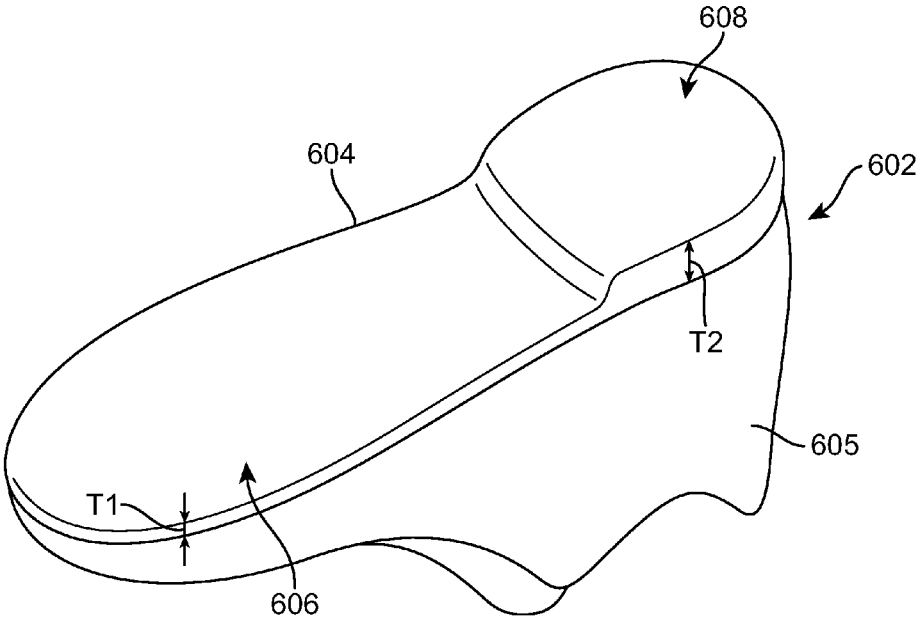

FIG. 6 illustrates a schematic view of an embodiment of protective member 100 and an associated article of footwear 602. Article of footwear 602 can include sole structure 604 and upper 605. In addition, sole structure 604 further includes forefoot portion 606 and heel portion 608. In this case, the thickness T1 of forefoot portion 606 is substantially less than the thickness T2 of heel portion 608. In order to accommodate this variation in sole thickness, first adjustment member 402 may be fastened within first interior portion 202 as described above and shown in FIG. 5. This configuration for protective member 100 decreases the depth of first interior portion 202.

FIG. 7 illustrates a schematic view of an embodiment of a graphic transfer assembly 700 that is used to apply graphic 702 to upper 605 of article of footwear 602. In this case, protective member 100 has been placed over sole structure 604 in order to protect sole structure 604 during the graphic transfer process. In some cases, protective member 100 may help protect sole structure 604 from heat and/or pressure that may be applied by first deformable membrane 710 and second deformable membrane 712.

The use of adjustment member 402 in first interior portion 202 helps to ensure that protective member 100 is evenly supported over sole structure 604. In particular, this arrangement helps ensure that peripheral edge 190 extends over sole structure 604 without substantially covering any of upper 605. Such an arrangement may help reduce the possibility of protective member 100 covering a portion of an upper where a graphic is being applied. This arrangement can also enhance stability for the protective system by reducing chances of protective member 100 rocking or tilting with respect to article of footwear 602.

Figure 8:
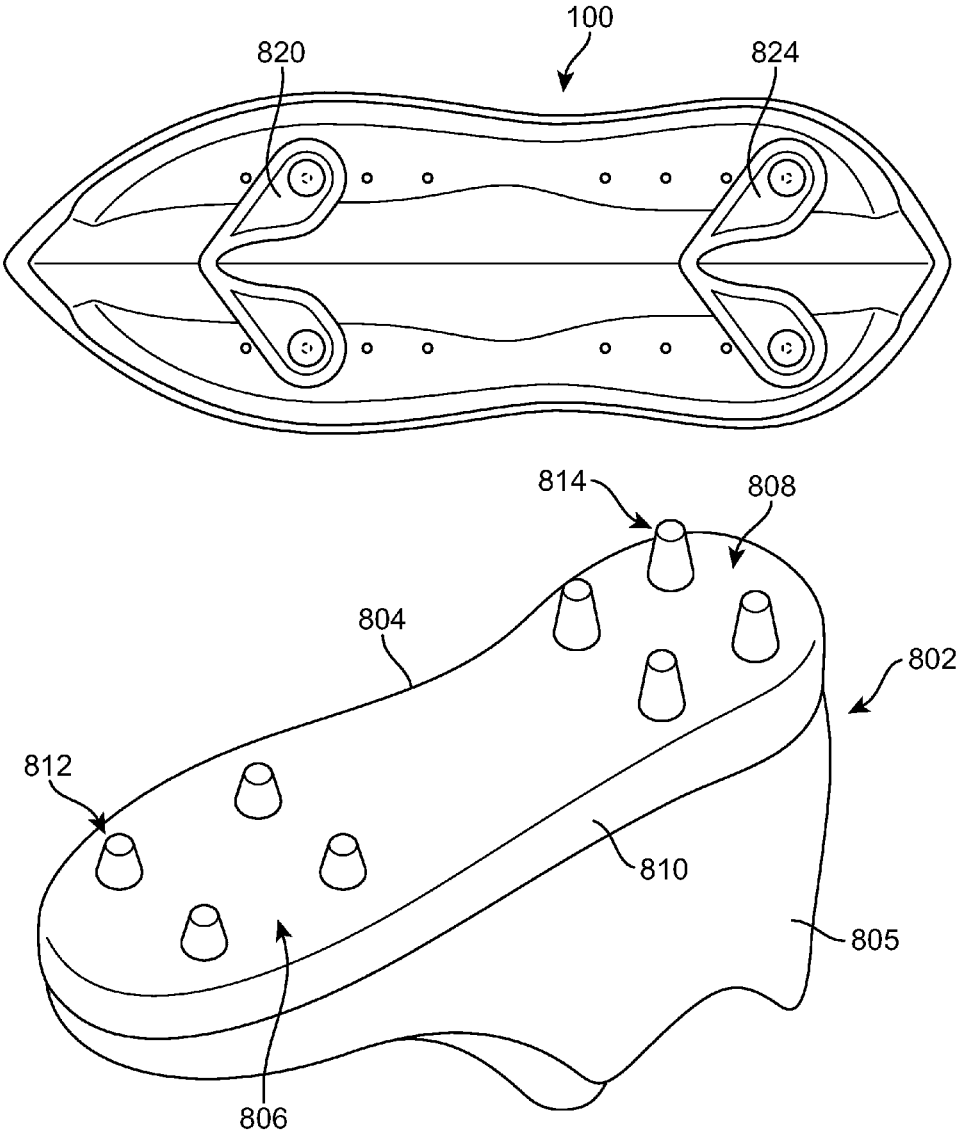
FIG. 8 is a schematic view of an embodiment of a protective member including two adjustment members being associated with an article of footwear.
Figure 9:
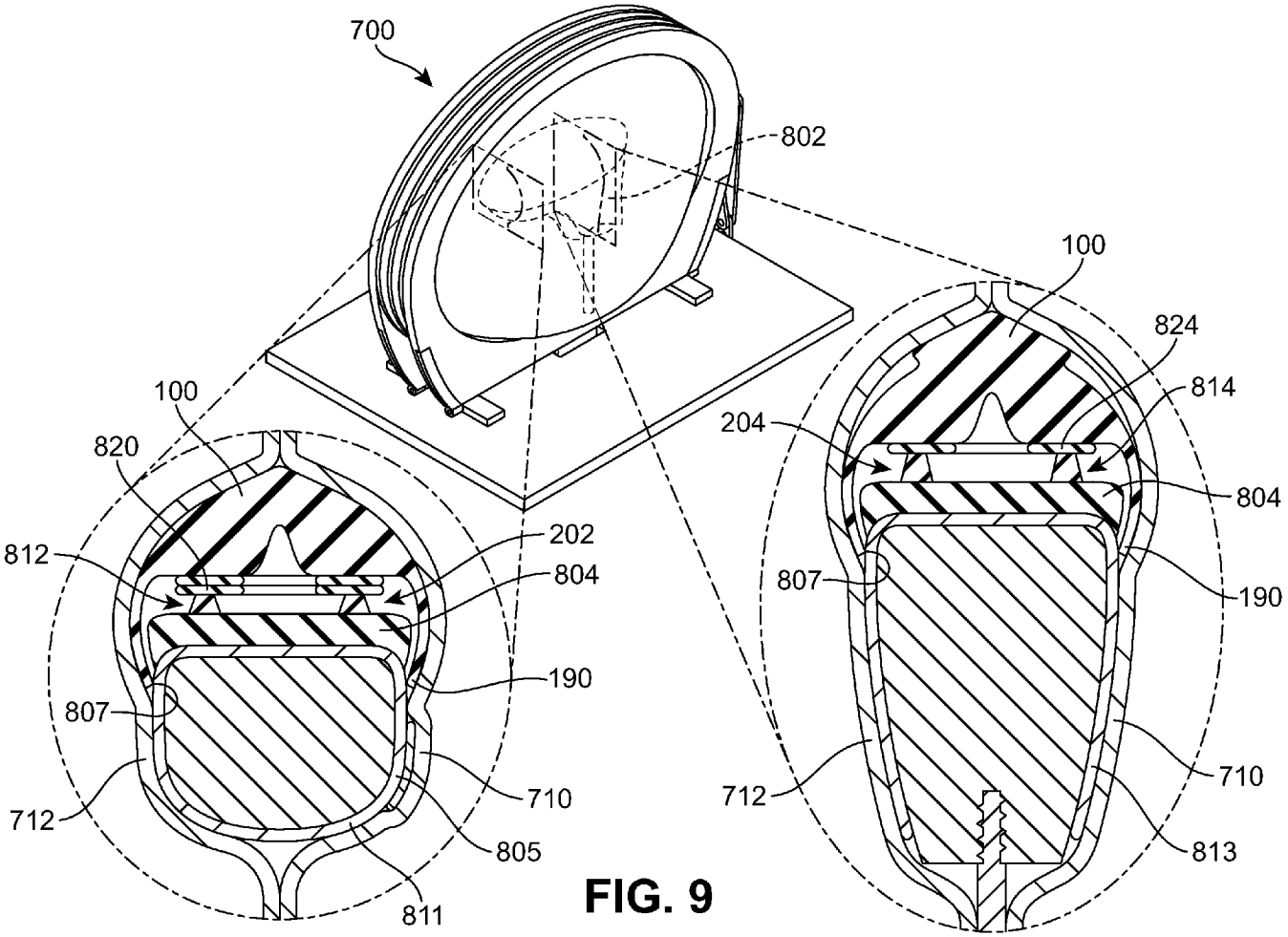
FIG. 9 is a schematic view of an embodiment of a graphic transfer assembly, in which a protective member is used to protect a sole structure.

FIGS. 8 and 9 illustrate another embodiment of a possible configuration for a protective system used with graphic transfer assembly 700. Referring to FIGS. 8 and 9, article of footwear 802 includes sole structure 804 and upper 805. In this case, the thickness of midsole portion 810 is approximately constant from forefoot portion 806 to heel portion 808. However, forefoot cleats 812 are substantially shorter than heel cleats 814, which results in a thicker heel profile for sole structure 604.

To accommodate this difference in cleat heights, protective member 100 is configured with first adjustment member 820 and second adjustment member 822. First adjustment member 820 may comprise two stackable members while second adjustment member 822 may comprise a single stackable member. This arrangement reduces the effective depth of first interior portion 202 relative to second interior portion 204, so that protective member 100 can sit evenly across sole structure 604 when inserted into graphic transfer assembly 700. Moreover, this arrangement provides a consistent positioning of peripheral edge 190 with respect to upper 805. For example, peripheral edge 190 is disposed adjacent to lower edge 807 of upper 805 in both forefoot portion 811 and heel portion 813 of article 802.

Figure 10:
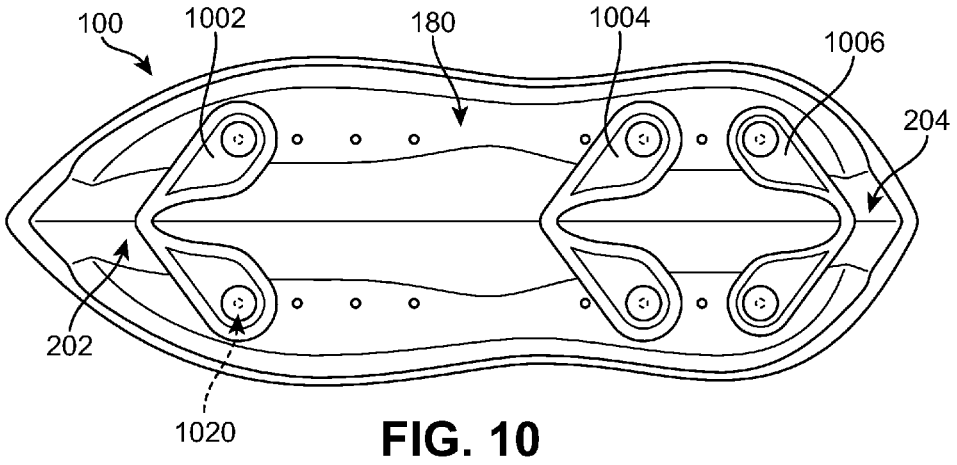
FIG. 10 is a schematic view of an embodiment of a configuration for three adjustment members attached to a protective member.
Figure 11:
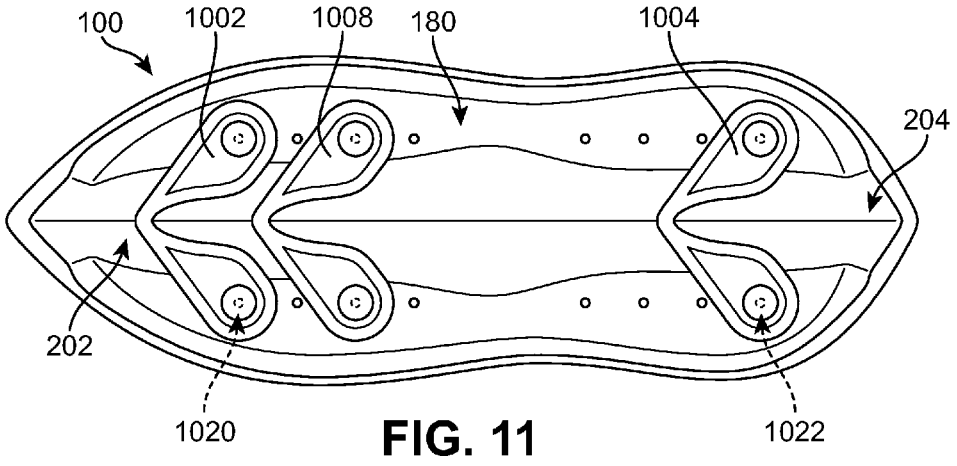
FIG. 11 is a schematic view of another embodiment of a configuration for three adjustment members attached to a protective member.

FIGS. 10 and 11 illustrate schematic views of various different configurations for a protective system. In particular, FIGS. 10 and 11 illustrate different possible positions and relative orientations for adjustment members that may be attached to protective member 100. Referring to FIG. 10, first adjustment member 1002 is attached to a forward pair of fastening holes 1020 of first interior portion 202. Also, second adjustment member 1004 and third adjustment member 1006 are attached to fastening holes along second interior portion 204. In particular, second adjustment member 1004 and third adjustment member 1006 are arranged so that the widest ends of the adjustment members are adjacent to one another.

As previously discussed, in some cases the relative sizes of one or more stackable members could vary. For example, in the current embodiment third adjustment member 1006 has a slightly smaller size than first adjustment member 1002 and second adjustment member 1004. In still other embodiments, the sizes of each stackable member could vary in any other manner.

Referring now to FIG. 11, fourth adjustment member 1008 has been inserted into first interior portion 202. In addition, third adjustment member 1006 has been removed. Furthermore, second adjustment member 1004 has been attached at a rearward pair of fastening holes 1022 of second interior portion 204.

It will be understood that the preceding Figures are only intended to illustrate a few possible arrangements of adjustment members within interior cavity 180. In other embodiments, any other number of adjustment members can be attached to first interior portion 202 and/or second interior portion 204. In still other embodiments, any other sizes and/or shapes of adjustment members could be attached to first interior portion 202 and second interior portion 204.

A protective system can include provisions for protecting portions of an upper. For example, some portions of an upper could be heat sensitive and it may be desirable to shield these portions from direct contact with components of a graphic transfer assembly. In some embodiments, a protective system may include one or more adjustable covering portions that can be used with a protective member to selectively cover portions of an upper.

Figure 12:
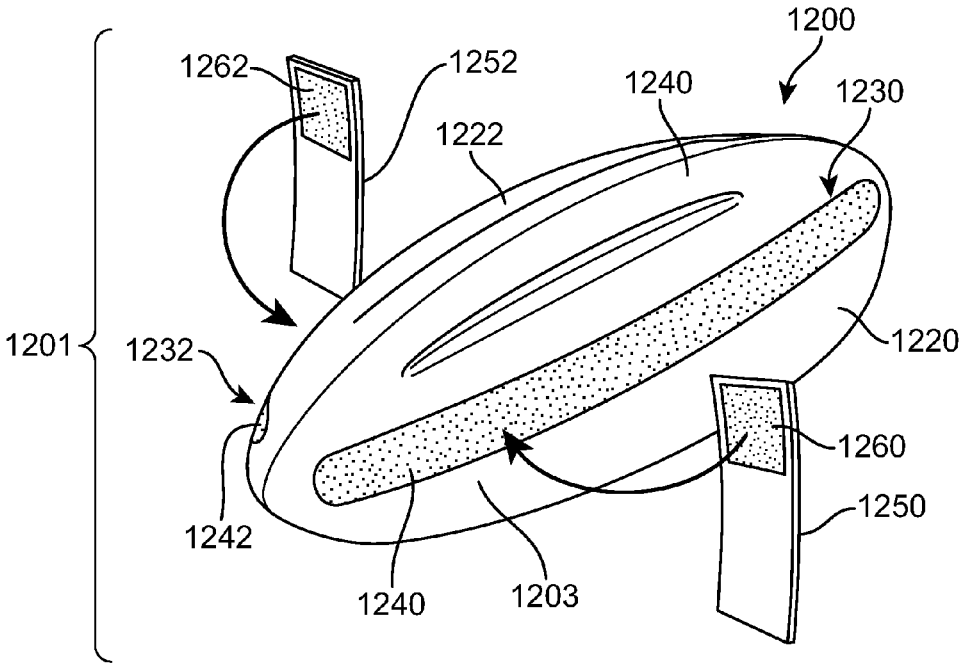
FIG. 12 is a schematic view of an embodiment of a protective member and two adjustable covering portions.

FIG. 12 illustrates a schematic isometric view of an embodiment of protective system 1201. In some cases, protective system 1201 includes protective member 1200. In some cases, protective member 1200 may be similar in some respects to protective member 100 discussed earlier. For example, in one embodiment, protective member 1200 may include first side portion 1220 and second side portion 1222 that are joined at distal portion 1240. Moreover, first side portion 1220 and second side portion 1222 may be generally separated at a peripheral edge, as described in earlier embodiments.

Protective member 1200 can include one or more attachment regions disposed on outer portion 1203. In some cases, protective member 1200 includes first attachment region 1230, which may be disposed on first side portion 1220. Additionally, in some cases, protective member 1200 may include second attachment region 1232 that is disposed on second side portion 1222. First attachment region 1230 and second attachment region 1232 can comprise any provisions for attaching various removable components to protective member 100. In some cases, first attachment region 1230 and second attachment region 1232 may comprise hook and loop fasteners, such as Velcro. For example, in one embodiment, first attachment region 1230 and second attachment region 1232 include first fastening strip 1240 and second fastening strip 1242, respectively. In other cases, however, any other types of fasteners or other attachment means could be used at first attachment region 1230 and/or second attachment region 1232.

Protective system 1201 may also include one or more adjustable covering portions. In some cases, protective system 1201 includes first adjustable covering portion 1250 and second adjustable covering portion 1252. In some cases, first adjustable covering portion 1250 and second adjustable covering portion 1252 may comprise flap-like portions that are configured to attach to protective member 1200. For example, in one embodiment, first adjustable covering portion 1250 includes fastening portion 1260 and second adjustable covering portion 1252 includes fastening portion 1262. Each fastening portion could comprise one or more kinds of fastening means for removably attaching to protective member 1200. In one embodiment, first fastening portion 1260 and second fastening portion 1262 are hook and loop fastener portions that can be attached to first attachment region 1230 and second attachment region 1232, respectively. In some cases, first fastening portion 1260 and second fastening portion 1262 are portions of a hook and loop fastener system that engage first fastening strip 1240 and second fastening strip 1242, respectively. This arrangement allows first adjustable covering portion 1250 and second adjustable covering portion 1252 to be attached to any location along the length of first attachment region 1230 and second attachment region 1232, respectively.

Although the current embodiment illustrates a protective member with two attachment regions, other embodiments could include any other number of attachment regions. Moreover, the attachment regions could extend over any location and may be oriented in any manner over the outer surface of a protective member.

Figure 13:
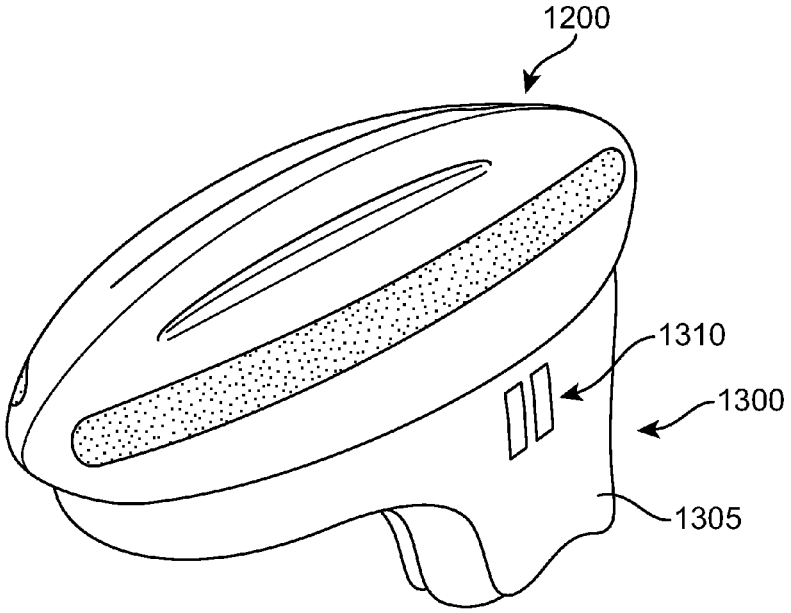
FIG. 13 is a schematic view of an embodiment of a protective member covering a sole structure.
Figure 14:
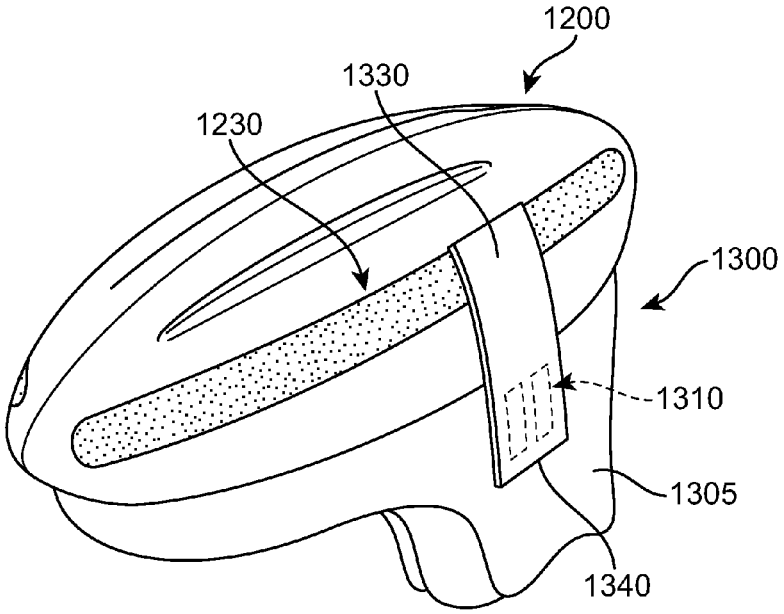
FIG. 14 is a schematic view of an embodiment of a protective member covering a sole structure, in which an adjustable covering portion is used.
Figure 15:
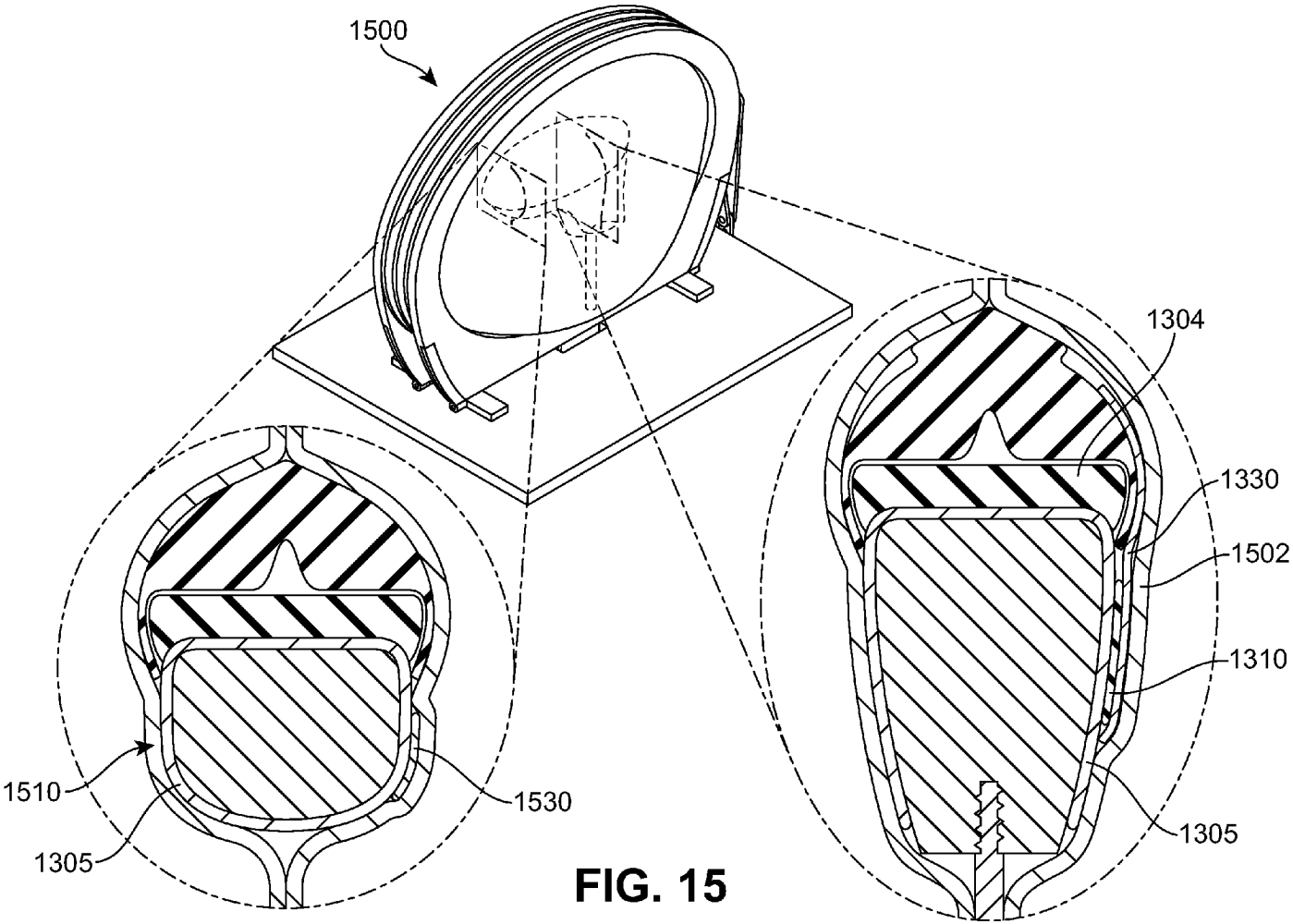
FIG. 15 is a schematic view of an embodiment of a graphic transfer assembly being used with a protective system that includes a protective member and an adjustable covering portion.

FIGS. 13 through 15 illustrate schematic views of an embodiment of an adjustable covering portion used to protect an upper. Referring to FIG. 13, protective member 1200 is placed onto article of footwear 1300 in order to cover footwear sole structure 1304 (see FIG. 15). In addition, upper 1305 includes decorative portion 1310 that may be made of a heat sensitive material. In order to prevent a deformable membrane from contacting and heating decorative portion 1310, adjustable covering portion 1330 may be used as a protective barrier. In some cases, adjustable covering portion 1330 may be attached to first attachment region 1230 of protective member 1200. In particular, adjustable covering portion 1330 may be attached at a location of first attachment region 1130 that is aligned with decorative portion 1310. This arrangement allows end portion 1340 of adjustable covering portion 1330 to hang down and cover decorative portion 1310.

As seen in FIG. 15, this arrangement allows adjustable covering portion 1330 to act as a protective barrier between deformable membrane 1502 of graphic transfer assembly 1500 and decorative portion 1310 of upper 1305. Moreover, graphic 1530 may applied to forefoot portion 1510 of upper 1305. In particular, deformable membrane 1502 is able to contact graphic 1530 in order to apply heat and pressure to graphic 1530. Therefore, this arrangement allows heat and pressure to be selectively applied to some portions of upper 1305 but not others.

Figure 16:
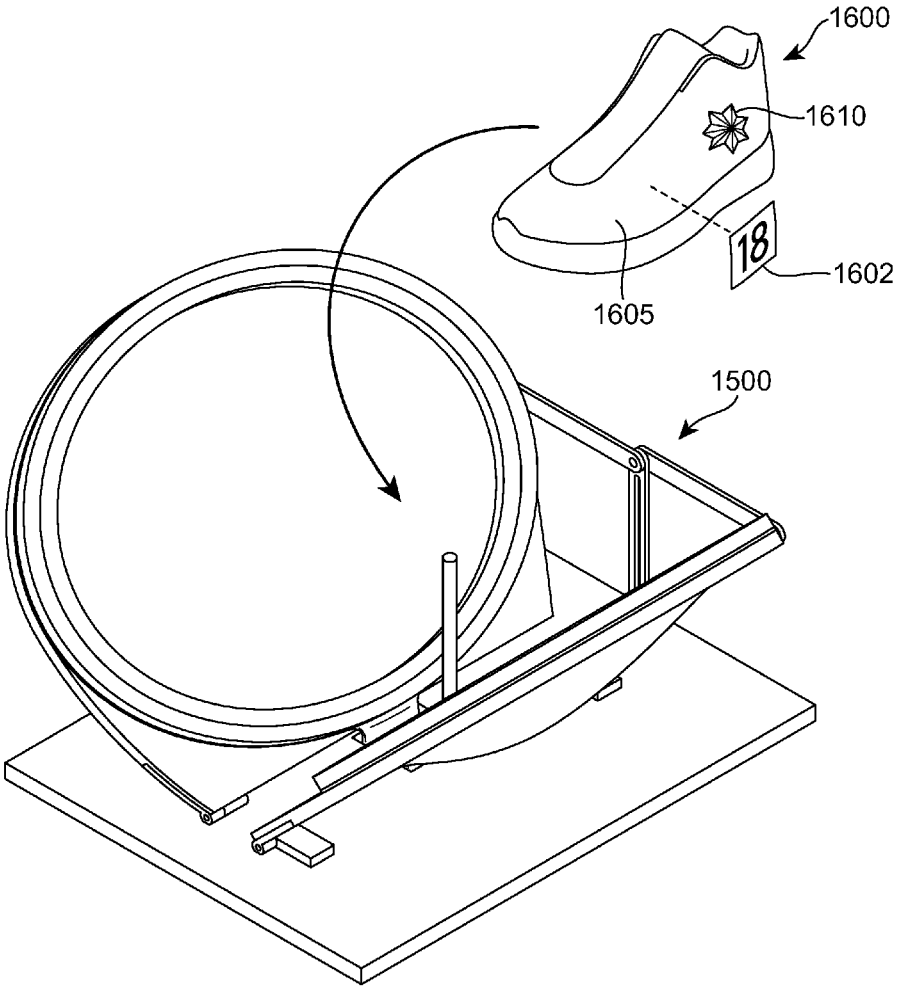
FIG. 16 is a schematic view of an embodiment of a graphic transfer assembly being used to apply a graphic to an article of footwear.
Figure 17:
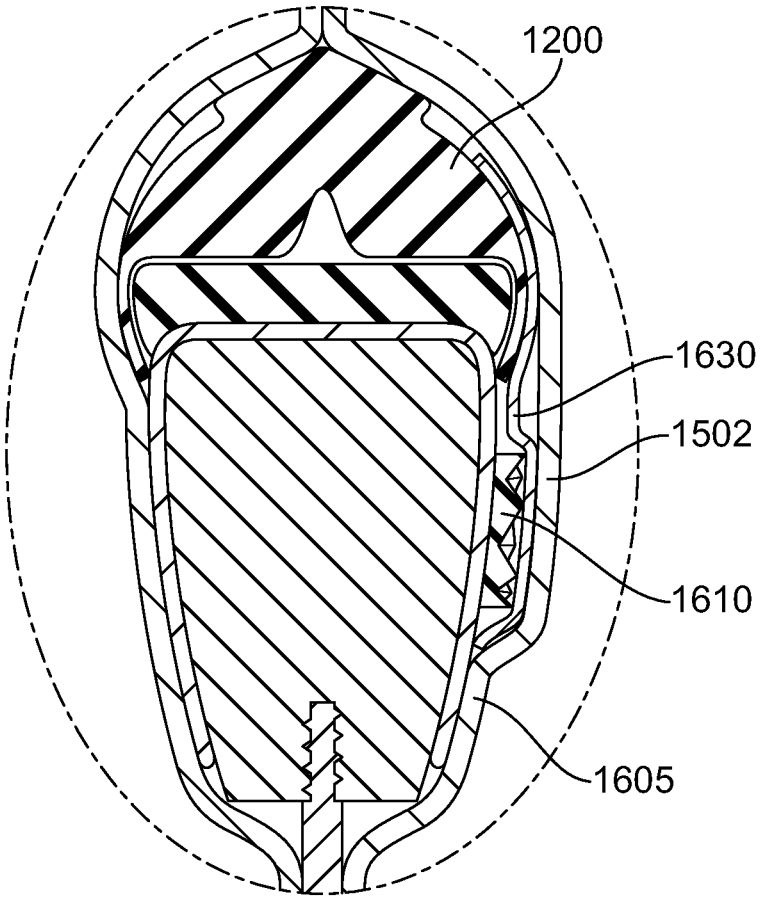
FIG. 17 is a schematic cross sectional view of an embodiment of an adjustable covering portion providing a protective barrier between a deformable membrane and a portion of a footwear upper.

Referring now to FIGS. 16 and 17, in some cases, an adjustable covering portion can also be used to protect one or more components of a graphic transfer assembly. For example, in the current embodiment, graphic 1602 is applied to upper 1605 of article of footwear 1600. Upper 1605 further includes jeweled portion 1610. Jeweled portion 1610 could be a plastic jewel-type decoration.

As seen in FIG. 17, adjustable covering portion 1630 may be attached to protective cover 1200. Moreover, adjustable covering portion 1630 may be configured to hang down from protective cover 1200 and over jeweled portion 1610. With this arrangement, adjustable covering portion 1630 may provide a protective layer between deformable membrane 1502 and footwear upper 1605 at the location of jeweled portion 1610. This helps prevent any potential damage to deformable membrane 1502 that might occur if deformable membrane 1502 were to be pressed directly against jeweled portion 1610.

Figure 18:
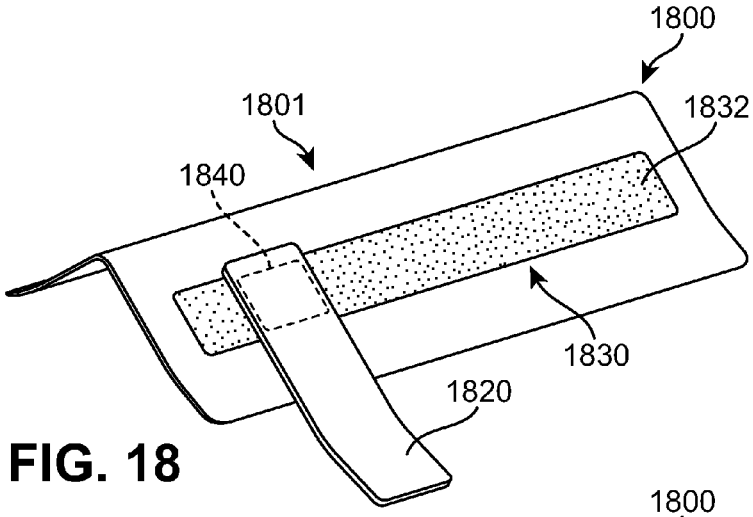
FIG. 18 is a schematic view of another embodiment of a protective member with an adjustable covering portion.

FIG. 18 illustrates an alternative embodiment of a protective system 1801 that includes protective member 1800 and adjustable covering portion 1820. In this case, protective member 1800 comprises a partially flexible material that may wrap around a sole structure. An example of such a protective member is disclosed in the Hull case. In some cases, protective member 1800 may include a first side portion 1810 and a second side portion 1812 for covering portions of a sole structure.

Some embodiments may include provisions for attaching protective member 1800 to a sole structure. As one example, protective member 1800 may be attached to a sole structure using a clamp system (not shown), as discussed in detail in the Hull case. However, in other embodiments, any other methods of attaching protective member 1800 to a sole structure could be used.

In the embodiment shown in FIG. 18, protective member 1800 is configured with attachment region 1830. Generally, any type of fastening system can be associated with attachment region 1830 for purposes of removably attaching adjustable covering portions to protective member 1800. In some cases, attachment region 1830 may be associated with a hook and loop fastener system. In some cases, attachment region 1830 further includes fastening strip 1832. Furthermore, adjustable covering portion 1820 may include fastening portion 1840 that may be removably attached to fastening strip 1832.

Figure 19:
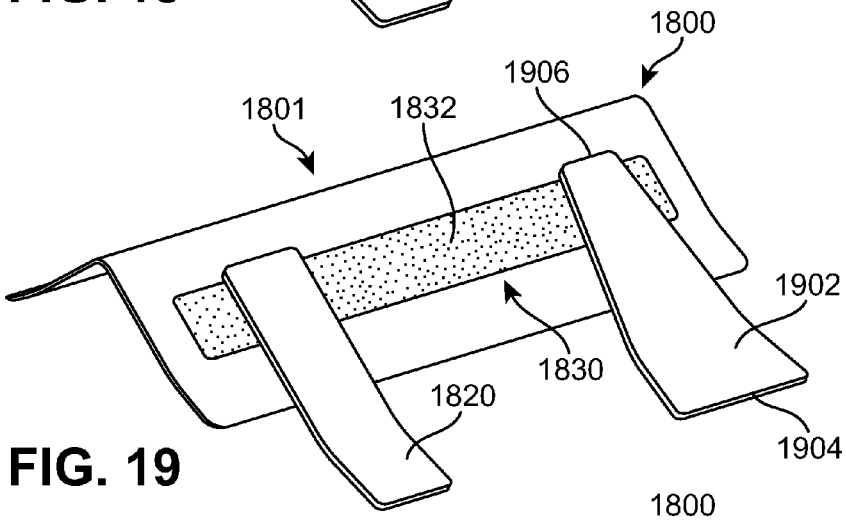
FIG. 19 is a schematic view of the protective member of FIG. 18 with two adjustable covering portions having different shapes.

A protective system can include provisions for selectively covering two or more distinct portions of an upper. In some cases, two or more adjustable covering portions could be used with a protective member. For example, as seen in FIG. 19, adjustable covering portion 1820 may be used simultaneously with adjustable covering portion 1902. This allows multiple portions of an upper to be selectively protected from heat during a graphic transfer process.

In different embodiments, the shapes of adjustable covering portions can vary. Examples of different shapes include, but are not limited to: triangular shapes, rectangular shapes, rounded shapes, polygonal shapes, regular shapes, irregular shapes as well as any other kinds of shapes. In one embodiment, as seen in FIG. 19, adjustable covering portion 1820 may have an approximately rectangular shape. In contrast, adjustable covering portion 1902 may have an approximately trapezoidal shape. In particular, distal edge 1906 of covering portion 1902 may be smaller than proximal edge 1904 of covering portion 1902. Using different shapes for adjustable covering portions may allow for more versatility in covering different portions of an upper.

In different embodiments, the sizes of adjustable covering portions can vary. Generally, the length and width of an adjustable covering portion can vary in order to achieve different types of coverage over an upper. In some cases, an adjustable covering portion may comprise a substantially narrow strip. In other cases, an adjustable covering portion can comprise a substantially wide portion.

Figure 20:
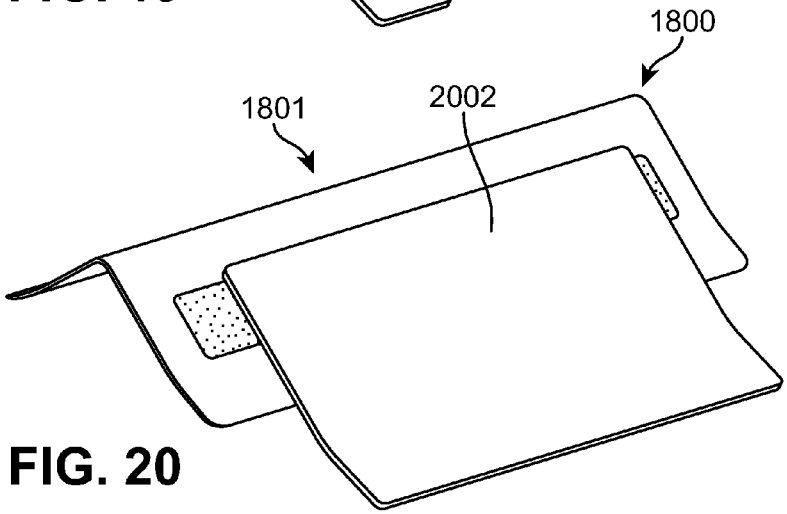
FIG. 20 is a schematic view of the protective member of FIG. 18 with a full length adjustable covering portion.

FIG. 20 illustrates another embodiment of an adjustable covering portion 2002 that may be used with protective member 1800. In this case, adjustable covering portion 2002 may extend along a majority of the length of protective member 1800. This type of coverage could be useful for covering one side of an upper during a graphic transfer process while applying a graphic to an opposing side of the upper. In addition to adjusting the width, it will be understood that in different embodiments the length and/or thickness of an adjustable covering portion could also vary. Moreover, in some cases, the shape and size of an adjustable covering portion may be tailored to cover a specific portion of an upper.

Generally, the material properties of an adjustable covering portion could vary. In some cases, adjustable covering portions may comprise materials with low thermal conductivity. In some cases, adjustable covering portions may comprise substantially flexible portions that adapt to the approximate curvature of an upper. In other cases, however, adjustable covering portions could be substantially rigid. Examples of materials that could be used for adjustable covering portions include, but are not limited to: plastic, rubber, woven and non-woven fabrics, composite materials as well as any other materials.

In some embodiments, the various features of a protective system described above can be used in combination with each other. For example, in some cases, a protective member can be configured to receive adjustment members as well as adjustable covering portions. This allows the user of a graphic transfer assembly to customize the graphic transfer process for particular articles of footwear.

Figure 21:
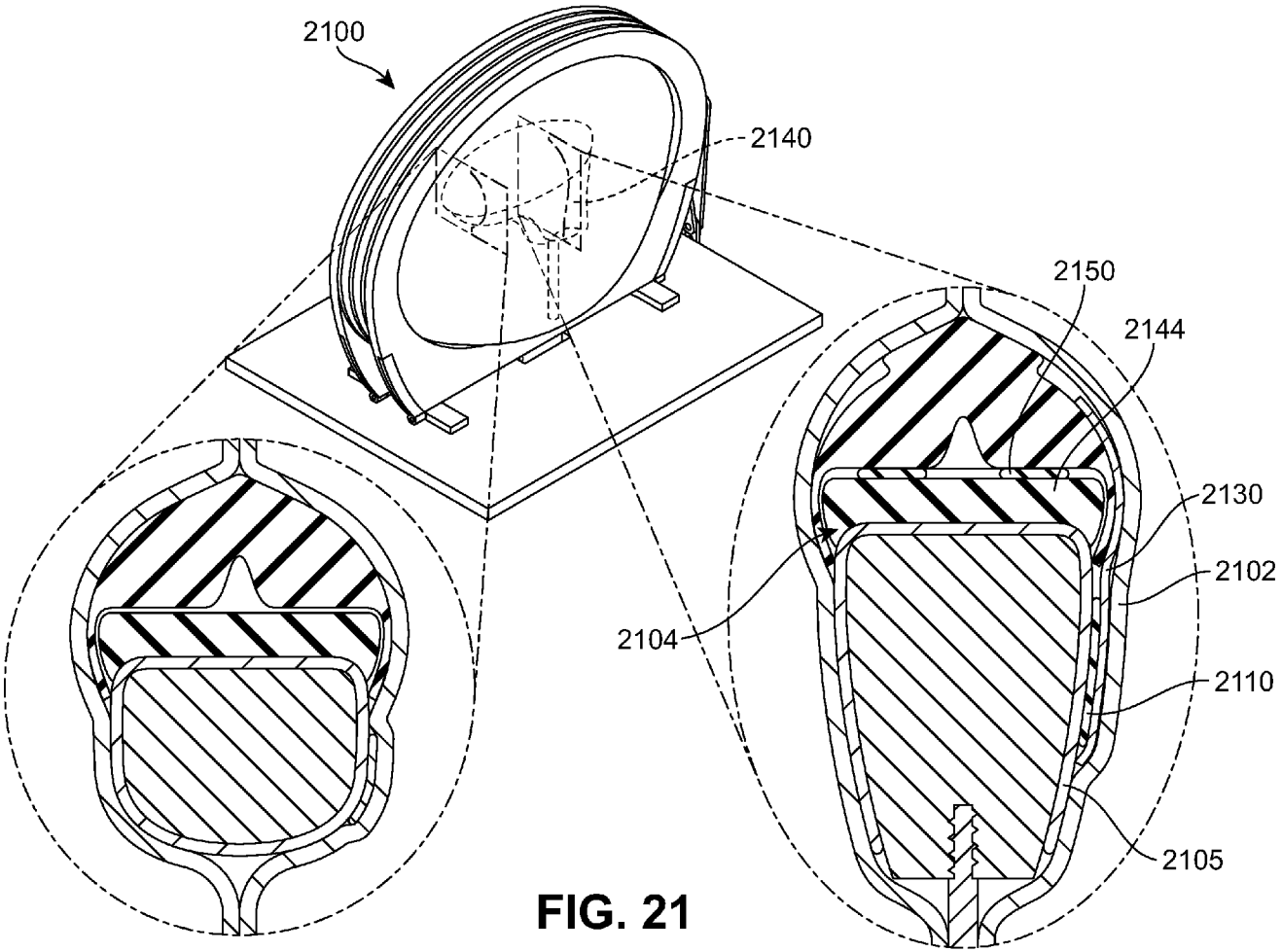
FIG. 21 is a schematic cross sectional view of an embodiment of an adjustable covering portion being used in combination with an adjustment member for a protective member.

FIG. 21 illustrates a schematic view of an exemplary embodiment in which a protective member is configured with an adjustment member as well as an adjustable covering member. Referring to FIG. 21, article of footwear 2140 has been inserted into graphic transfer assembly 2100. In this case, adjustment member 2150 has been applied to second interior portion 204 of protective member 100. This arrangement may adjust the effective depth of second interior portion 204 in order to accommodate the variable thickness of sole structure 2144 of article of footwear 2140. Additionally, adjustable covering portion 2130 has been attached to protective member 100 in order to protect portion 2110 of upper 2105 from deformable membrane 2102. This configuration for protective member 100 helps increase the versatility of protective member 100, since these features allow protective member 100 to be used with a variety of different articles having various sole structure dimensions as well as various upper configurations.

A protective member may include provisions for preventing relative movement between a protective member and an article during use. In some embodiments, a protective member can be configured to tighten around, or clamp down onto, a sole structure or other component of an article. This may help reduce the tendency of the protective member to slip or otherwise move relative to the sole structure during various processes, such as a graphic transfer process.

Figure 22:
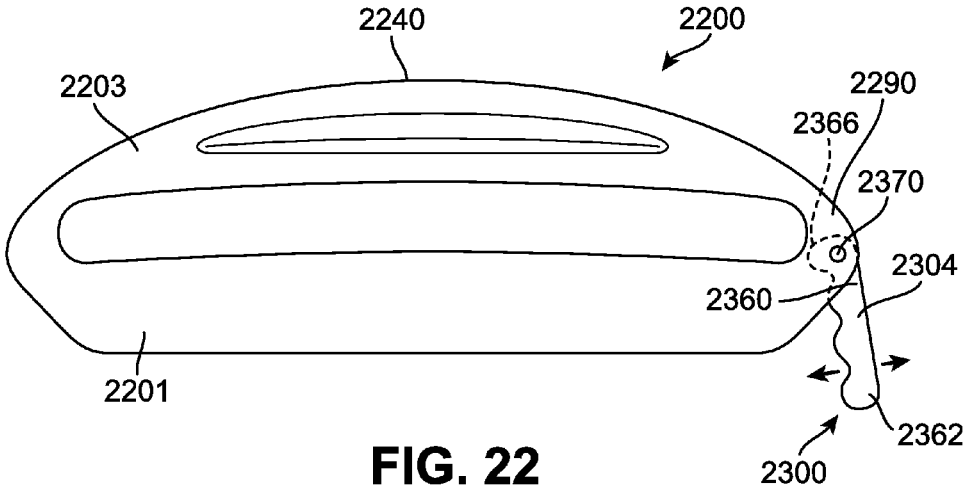
FIG. 22 is a schematic side view of an embodiment of a protective member including a fit adjustment system.
Figure 23:
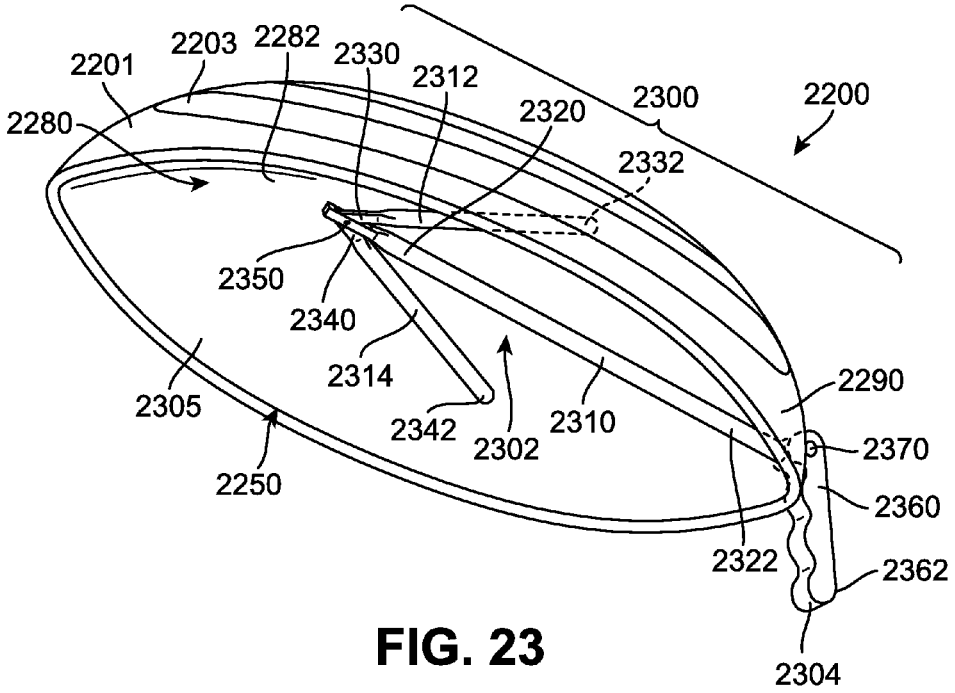
FIG. 23 is an isometric view of a lower side of the protective member of FIG. 22.

FIGS. 22 and 23 illustrate schematic views of an embodiment of protective member 2200 that includes a fit adjustment system 2300. In particular, FIG. 22 illustrates a side view of an embodiment of protective member 2200, while FIG. 23 illustrates an isometric view of a proximal portion 2201 of protective member 2200. The term "fit adjustment system" as used throughout this detailed description and in the claims refers to any component or combination of components that may be used to adjust one or more dimensions of a protective member or otherwise adjust protective member 2200 in a manner that changes the fit of protective member 2200 with a corresponding article of footwear. The following embodiments illustrate a fit adjustment system 2300 that uses a linkage assembly to adjust the dimensions of protective member 2200, though other embodiments could utilize other kinds of adjustment systems.

Referring to FIGS. 22 and 23, protective member 2200 may share similar features with previous embodiments. Though it will be understood that protective member 2200 may not share all the provisions of earlier embodiments and could include additional provisions not previously described. Protective member 2200 may comprise a substantially contoured member. In particular, protective member 2200 may comprise a contoured first side portion 2203 and a contoured second side portion 2205. First side portion 2203 and second side portion 2205 may be separated at proximal portion 2201 of protective member 2200. In some cases, first side portion 2203 and second side portion 2205 may be joined together within distal portion 2240.

In some embodiments, proximal portion 2201 can be configured to receive a sole structure of an article of footwear. As described above, in other embodiments where protective member 2200 is configured for use with other kinds of articles, proximal portion 2201 may be configured to receive any other portion of an article. In some embodiments, proximal portion 2201 may include opening 2250 that provides access to interior cavity 2280.

Fit adjustment system 2300 may comprise various components including a linkage assembly 2302 and a handle member 2304. In some embodiments, linkage assembly 2302 may comprise multiple linkage members that are attached to one another using various kinds of fasteners. In one embodiment, linkage assembly 2302 may include first linkage member 2310, second linkage member 2312 and third linkage member 2314. Moreover, first linkage member 2310 may include a first end portion 2320 and a second end portion 2322. Likewise, second linkage member 2312 may include a first end portion 2330 and a second end portion 2332. Also, third linkage member 2314 may include a first end portion 2340 and a second end portion 2342.

In some embodiments, first linkage member 2310, second linkage member 2312 and third linkage member 2314 are connected to one another. In one embodiment, first end portion 2320, first end portion 2330 and first end portion 2340 of first linkage member 2310, second linkage member 2312 and third linkage member 2314, respectively, may all be joined together using fastener 2350. In some embodiments, fastener 2350 may be a pin, screw, rivet or similar kind of fastener that allows first linkage member 2310, second linkage member 2312 and third linkage member 2314 to pivot with respect to one another. In other embodiments, however, first linkage member 2310, second linkage member 2312 and third linkage member 2314 may not be connected in a pivoting manner and could instead be permanently attached to one another.

In some embodiments, linkage assembly 2302 may be disposed within protective member 2200. In some embodiments, linkage assembly 2302 may be disposed within interior cavity 2280. In other embodiments, however, linkage assembly 2302 may be embedded within interior surface portion 2282 of interior cavity 2280. The embodiment shown in FIG. 23 is intended to be schematic and shows linkage assembly 2302 exposed within interior cavity 2280, however other embodiments may include provisions for hiding or otherwise embedding portions of linkage assembly 2302 within various portions of protective member 2200 so that some or all portions of linkage assembly 2302 are internal components not visible to a user. As an example, in embodiments where protective member 2200 is made of a lightweight foam or plastic material, protective member 2200 could include one or more channels, cavities or other internal provisions for housing some or all components of linkage assembly 2302.

The arrangement of first linkage member 2310, second linkage member 2312 and third linkage member 2314 within protective member 2200 can vary in different embodiments. In some embodiments, first linkage member 2310 may generally extend along a longitudinal direction of protective member 2200. In addition, in some embodiments, second linkage member 2312 and third linkage member 2314 may be oriented in directions that are generally angled with respect to the longitudinal direction, though as discussed below the orientations of second linkage member 2312 and third linkage member 2314 may be changed during use.

Some components of linkage assembly 2302 may be attached directly to portions of protective member 2200 at one or more end portions, while other components could include free end portions. For example, in some embodiments, second linkage member 2312 and third linkage member 2314 may be attached directly to protective member 2200 at second end portion 2332 and second end portion 2342, respectively. In particular, in some cases, second end portion 2332 of second linkage member 2312 may be attached directly to first side portion 2203 of protective member 2200. Likewise, in some cases, second end portion 2342 of third linkage member 2314 may be attached directly to second side portion 2205 of protective member 2200. In contrast, in some embodiments, first end portion 2320, first end portion 2330 and first end portion 2340 of first linkage member 2310, second linkage member 2312 and third linkage member 2314 may not be fixed in place with respect to protective member 2200. Instead, as discussed in further detail below, some embodiments can be configured so that these first end portions are free to move relative to other portions of protective member 2200.

Handle member 2304 may be attached to rearward end portion 2290 of protective member 2200. In some cases, first end portion 2360 of handle member 2304 may be configured to pivot about fastener 2370 that joins handle member 2304 with protective member 2200. Moreover, in some cases, second end portion 2362 of handle member 2304 may be a free end that can move, which allows handle member 2304 to pivot about fastener 2370.

Handle member 2304 can include provisions for engaging and interacting with linkage assembly 2302. In some embodiments, first end portion 2360 of handle member 2304 may include cam portion 2366. Cam portion 2366 may be a portion that extends or projects outwardly from first end portion 2360. Moreover, as handle member 2304 is adjusted, cam portion 2366 may rotate to various angular positions about an axis corresponding to fastener 2370.

Figure 24:
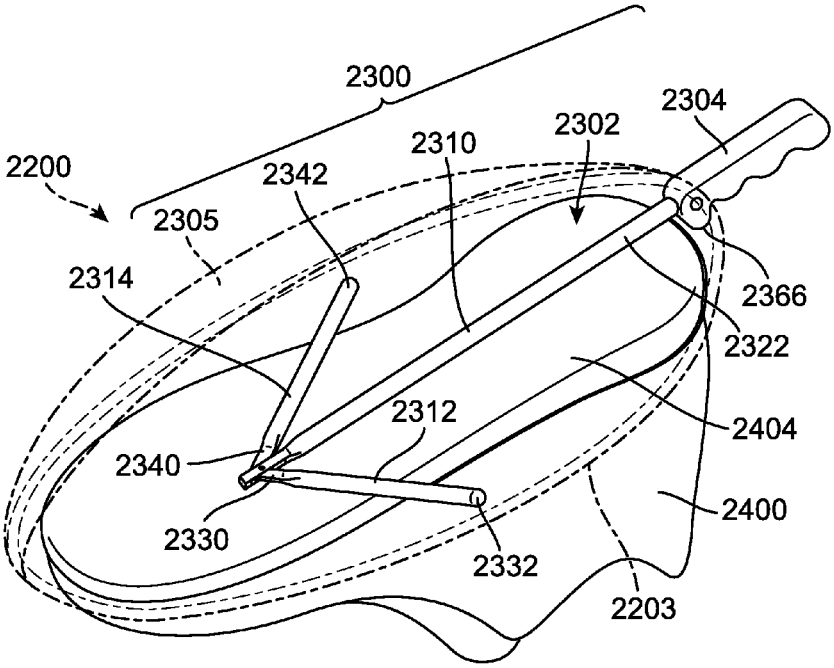
FIG. 24 is an isometric view of an embodiment of the operation of the fit adjustment system within the protective member of FIG. 22.
Figure 25:
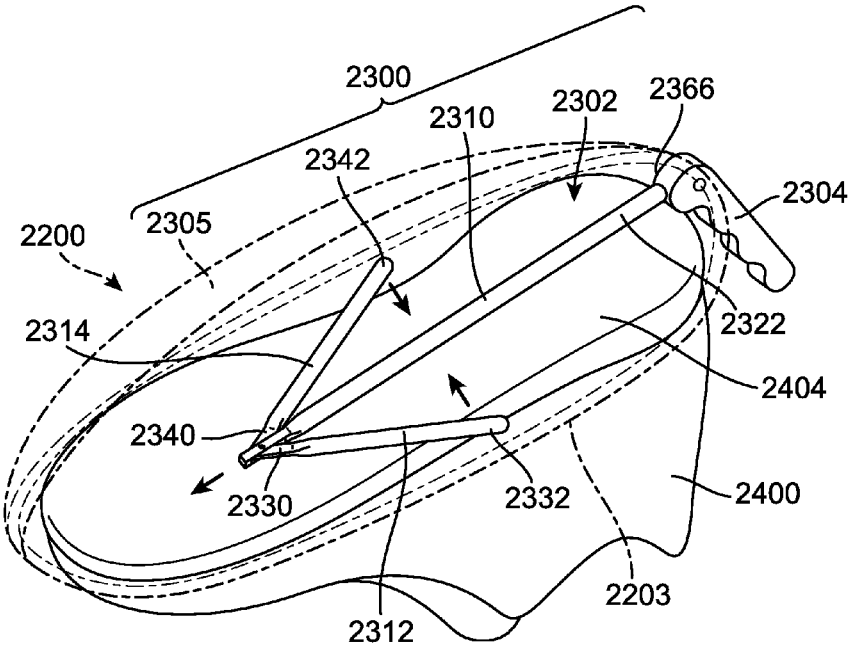
FIG. 25 is an isometric view of an embodiment of the operation of the fit adjustment system within the protective member of FIG. 22, in which the protective member has been tightened around a sole.
Figure 26:
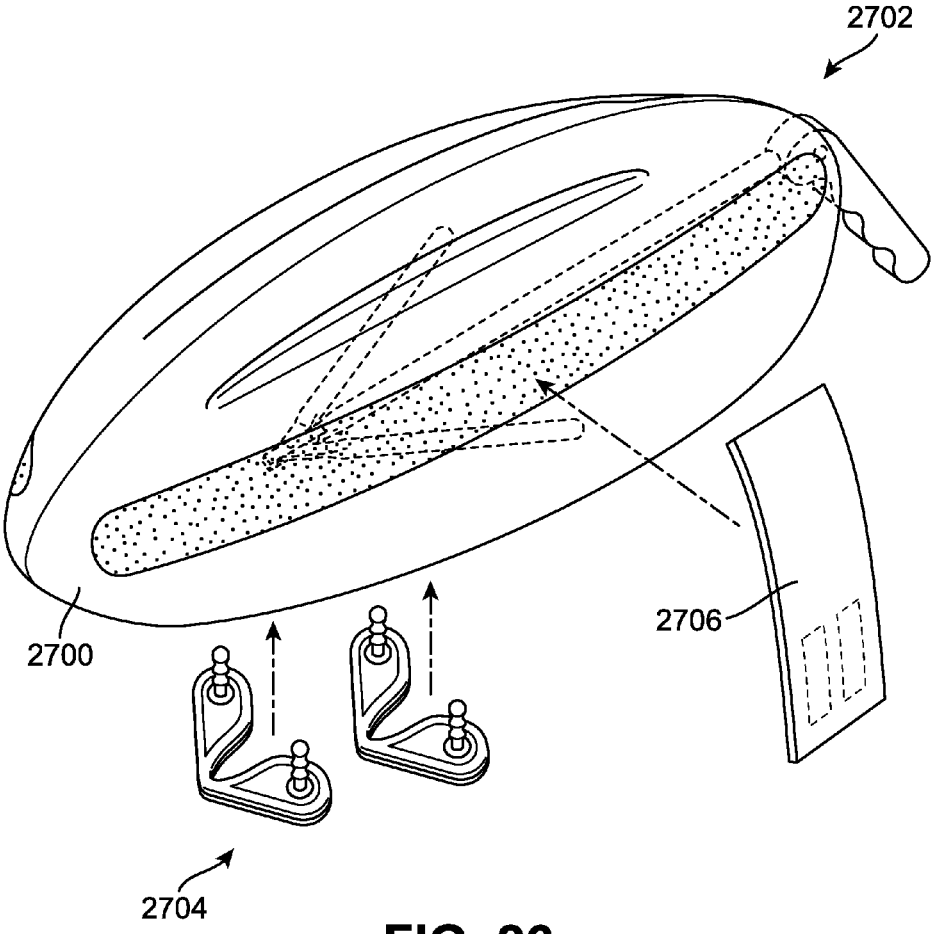
FIG. 26 is a schematic isometric view of a protective member with a fit adjustment system configured for use with height adjustment members as well as with covering portions.

FIGS. 24 and 25 illustrate schematic isometric views of protective member 2200 covering sole structure 2404 of article of footwear 2400, which are intended to illustrate the general operation of fit adjustment system 2300 according to an embodiment. For purposes of clarity, protective member 2200 is shown in phantom. As seen in FIG. 24, handle member 2304 is disposed in a first position where cam portion 2366 is rotated away from second end portion 2322 of first linkage member 2310. This has the effect of allowing linkage assembly 2302 to maintain a default configuration. In this default configuration, the orientation of second linkage member 2312 and third linkage member 2314 may be determined by the natural position of first side portion 2203 and second side portion 2205 of protective member 2200.

Referring now to FIG. 25, as handle member 2304 is rotated to a second position, cam portion 2366 rotates to a position that engages second end portion 2322 of first linkage member 2310. This has the effect of pushing first linkage member 2310 forwards and thereby retracting second end portion 2332 of second linkage member 2312 and second end portion 2342 of third linkage member 2314. This retraction further pulls first side 2203 and second side 2205 closer together, thereby reducing the width of interior cavity 2280 (see FIG. 23). Thus, by rotating handle member 2304 between the first, or loosened, position and the second, or tightened, position, linkage assembly 2302 is adjusted to tighten protective member 2200 around sole structure 2404.

Although FIGS. 24 and 25 illustrate two configurations where fit adjustment system 2300 operates between a first (loose) configuration and a second (tightened) configuration, other embodiments may include various intermediate configurations. In some cases, for example, handle member 2304 may be adjusted to any position between the fully loosened and fully tightened positions. Such intermediate positions may allow for various degrees of tightening and could also allow protective member 2200 to be used with various sized articles.

The arrangement of linkages in linkage assembly 2302 is only intended to be exemplary. In other embodiments, for example, a linkage assembly could comprise any number of linkage members that are arranged in any configurations. The number of linkage members and configurations for the linkage members can be selected according to various properties including the geometry of a protective member, the desired degree of tightening for the protective member, the geometries and arrangements of additional components that may be assembled with a protective member as well as any other properties.

Protective members with fit adjustment systems can also be used in combination with one or more of the features described in earlier embodiments. For example, a protective member including a fit adjustment system can also be configured for use with height adjustment members and/or covering portions. Referring to FIG. 27, protective member 2700 includes fit adjustment system 2702 and may also be configured for use with height adjustable members 2704 and covering portion 2706. Moreover, any modifications to the design for a linkage assembly described above and shown in FIGS. 22 through 25 can be made to accommodate height adjustment members as well as covering portions. This arrangement may allow a protective member to be used with a wide variety of footwear, including footwear of varying sole heights as well as footwear of varying sole widths.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A protective system for an article of footwear, comprising:

a protective member, the protective member being sized and dimensioned to cover and engage a sole structure of the article of footwear;

the protective member including an interior cavity;

the interior cavity further including an interior portion;

the interior portion having an effective depth, the effective depth being associated with the shallowest portion of the interior portion;

at least a first adjustment member that can be removably attached to the interior portion;

wherein the interior portion includes a base portion and a sidewall portion, wherein the base portion includes a first fastening hole and a second fastening hole;

wherein the first adjustment member comprises a first stackable member, the first stackable member includes a first post member and a second post member;

wherein the first fastening hole is configured to receive the first post member and the second fastening hole is configured to receive the second post member;

wherein the first adjustment member is configured to be disposed between the base portion and the sole structure when the first adjustment member is attached to the interior portion by inserting the first post member into the first fastening hole and also inserting the second post member into the second fastening hole; and wherein the first adjustment member can be used to decrease the effective depth of the interior portion.

2. The protective system according to claim 1, wherein the protective member is a substantially rigid member.

3. The protective system according to claim 1, wherein the interior portion is configured to receive two or more adjustment members.

4. The protective system according to claim 1, wherein the first adjustment member comprises a second stackable member that is configured to be joined to the first stackable member using the first post member.

5. The protective system according to claim 4, wherein the first adjustment member is spaced apart from the sidewall portion when the first adjustment member is attached to the interior portion.

6. The protective system according to claim 4, wherein a thickness of the first adjustment member can be increased by joining the second stackable member with the first stackable member.

7. The protective system according to claim 1, further including a second adjustment member comprising at least two stackable members.

8. The protective system according to claim 1, wherein the protective member is used with a graphic transfer assembly.

9. The protective system according to claim 1, wherein the protective system further includes:

an attachment region disposed on an outer portion of the protective member;

an adjustable covering portion that can be removably attached to the attachment region; and wherein the adjustable covering portion is configured to selectively cover a portion of an upper.

10. A protective system for an article of footwear, comprising:

a protective member, the protective member being sized and dimensioned to cover and engage a sole structure of the article of footwear;

the protective member including a proximal portion and a distal portion, wherein the proximal portion includes an opening that is configured to receive a sole structure;

the protective member comprising a first side portion and a second side portion, wherein the first side portion and the second side portion are joined and form a tapered edge proximate the distal portion of the protective member;

the protective member including an attachment region disposed on an outer portion of the protective member, wherein the attachment region includes a fastening strip;

the attachment region extending along a substantial entirety of a length of the first side portion;

at least one adjustable covering portion that can be removably attached at any location on the fastening strip; and wherein the at least one adjustable covering portion is configured to selectively cover a portion of an upper.

11. The protective system according to claim 10, wherein the at least one adjustable covering portion includes a first end and a second end, wherein the first end is configured to be removably attached to the attachment region, and wherein the second end is configured to cover a portion of an upper.

12. The protective system according to claim 11, wherein the fastening strip is a hook and loop type fastening strip.

13. The protective system according to claim 11, wherein the first end of the at least one adjustable covering portion includes a corresponding fastening portion for engaging the fastening strip.

14. The protective system according to claim 10, wherein the protective system includes a first adjustable covering portion and a second adjustable covering portion that may each be removably attached to the attachment region.

15. The protective system according to claim 14, wherein the first adjustable covering portion has a first shape and the second adjustable covering portion has a second shape and wherein the first shape is substantially different from the second shape.

16. The protective system according to claim 14, wherein the first adjustable covering portion has a first size and the second adjustable covering portion has a second size and wherein the first size is substantially different from the second size.

17. The protective system according to claim 10, wherein the at least one adjustable covering portion comprises a material with a low thermal conductivity.

18. The protective system according to claim 10, wherein the protective system includes an adjustment member that can be used to adjust an effective depth of an interior portion of the protective member, the effective depth being associated with the shallowest portion of the interior portion.

19. The protective system according to claim 10, wherein the protective member includes a fit adjustment system for adjusting the fit of the protective member with a sole structure.

20. The protective system according to claim 19, wherein the fit adjustment system comprises a linkage assembly and a handle member and wherein rotating the handle member adjusts the linkage assembly between a first configuration and a second configuration and wherein the second configuration is associated with a narrower width for a proximal portion of the protective member than the first configuration.

21. The protective system according to claim 19, wherein the fit adjustment system can be used to decrease the width of an opening for an interior cavity of the protective member.

22. A protective system for an article of footwear, comprising:

a protective member, the protective member being sized and dimensioned to cover and engage a sole structure of the article of footwear;

the protective member including an interior cavity;

the interior cavity further including a first interior portion and a second interior portion;

the first interior portion having a first effective depth, the first effective depth being associated with the shallowest portion of the first interior portion;

the second interior portion having a second effective depth, the second effective depth being associated with the shallowest portion of the second interior portion;

a first adjustment member that can be removably attached to the first interior portion;

wherein the protective member includes a fit adjustment system for adjusting the fit of the protective member with a sole structure; and wherein the first adjustment member can be used to change the first effective depth of the first interior portion so that the first effective depth is substantially different than the second effective depth.

23. The protective system according to claim 22, wherein the protective system includes a second adjustment member that can be removably attached to the second interior portion.

24. The protective system according to claim 23, wherein a thickness of the first adjustment member is substantially different than a thickness of the second adjustment member.

25. The protective system according to claim 24, wherein the first adjustment member comprises more stackable members than the second adjustment member.

26. The protective system according to claim 24, wherein the second adjustment member comprises more stackable members than the first adjustment member.

27. The protective system according to claim 23, wherein the first adjustment member can be used to change the first effective depth of the first interior portion and wherein the second adjustment member can be used to change the second effective depth of the second interior portion.

28. The protective system according to claim 23, wherein the first effective depth and the second effective depth can be changed independently.

29. The protective system according to claim 22, wherein the first interior portion is configured to cover a forefoot portion of the sole structure, and wherein the second interior portion is configured to cover a heel portion of the sole structure.

30. The protective system according to claim 29, wherein the fit adjustment system comprises a linkage assembly and a handle member and wherein rotating the handle member adjusts the linkage assembly between a first configuration and a second configuration and wherein the second configuration is associated with a narrower width for a proximal portion of the protective member than the first configuration.

31. The protective system according to claim 29, wherein the fit adjustment system can be used to decrease the width of an opening for an interior cavity of the protective member.

* * * * *